US009305433B2

(12) United States Patent
Vann et al.

(10) Patent No.: US 9,305,433 B2
(45) Date of Patent: Apr. 5, 2016

(54) SYSTEMS, METHODS AND DEVICES FOR PLAYING WAGERING GAMES WITH DISTRIBUTED COMPETITION FEATURES

(71) Applicant: WMS Gaming Inc., Waukegan, IL (US)

(72) Inventors: Jamie W. Vann, Chicago, IL (US); Andrew C. Guinn, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 124 days.

(21) Appl. No.: 13/760,532

(22) Filed: Feb. 6, 2013

(65) Prior Publication Data

US 2014/0024437 A1 Jan. 23, 2014

Related U.S. Application Data

(60) Provisional application No. 61/674,125, filed on Jul. 20, 2012.

(51) Int. Cl.
*G06F 17/00* (2006.01)
*G07F 17/32* (2006.01)

(52) U.S. Cl.
CPC ..... *G07F 17/3279* (2013.01)

(58) Field of Classification Search
CPC ..... G07F 17/3276
See application file for complete search history.

(56) References Cited

U.S. PATENT DOCUMENTS 4,527,798 A 7/1985 Siekierski et al.
4,624,459 A 11/1986 Kaufman
4,805,907 A 2/1989 Hagiwara
4,837,728 A 6/1989 Barrie et al.
4,856,787 A 8/1989 Itkis (Continued)

FOREIGN PATENT DOCUMENTS

CA 2334546 A1 8/2001
DE 195 15 983 A1 11/1996

(Continued)

OTHER PUBLICATIONS

Multiple Announcer request. dev.dota2.com. Online. Jun. 30, 2012. Accesseed via the Internet. Accessed Aug. 23, 2015. <URL:http://dev.dota2.com/showthread.php?t=43906>.*

(Continued)

*Primary Examiner* — Dmitry Suhol
*Assistant Examiner* — Carl V Larsen
(74) *Attorney, Agent, or Firm* — Nixon Peabody LLP

(57) ABSTRACT

Gaming devices, gaming systems, methods of conducting wagering games, and computer programs for executing wagering games are disclosed. A gaming system for playing a wagering game is disclosed which includes a processor(s) and a memory device(s) storing instructions that, when executed by at least one of the processors, cause the gaming system to: display, via a display device(s), a randomly determined outcome of the wagering game; responsive to a triggering event, transmit an offer to participate in a competitive gaming feature to a second player(s); randomly determine a first final outcome of the competitive gaming feature for the first player; randomly determine a second final outcome of the competitive gaming feature for the second player; and, in response to a valuation of the first final outcome being better than a valuation of the second final outcome, award a competitive gaming feature award to the first player.

25 Claims, 8 Drawing Sheets

(56) References Cited

U.S. PATENT DOCUMENTS

| | | | |
|---|---|---|---|
| 4,948,134 | A | 8/1990 | Suttle et al. |
| 5,116,055 | A | 5/1992 | Tracy |
| 5,249,800 | A | 10/1993 | Hilgendorf et al. |
| 5,275,400 | A | 1/1994 | Weingardt et al. |
| 5,280,909 | A | 1/1994 | Tracy |
| 5,299,803 | A | 4/1994 | Halaby |
| 5,344,144 | A | 9/1994 | Canon |
| 5,377,973 | A | 1/1995 | Jones et al. |
| 5,393,057 | A | 2/1995 | Marnell |
| 5,397,133 | A | 3/1995 | Penzias |
| 5,470,079 | A | 11/1995 | LeStrange et al. |
| 5,489,103 | A | 2/1996 | Okamoto |
| 5,524,888 | A | 6/1996 | Heidel |
| 5,544,892 | A | 8/1996 | Breeding |
| 5,564,700 | A | 10/1996 | Celona |
| 5,580,063 | A | 12/1996 | Edwards |
| 5,580,309 | A | 12/1996 | Piechowiak et al. |
| 5,586,937 | A | 12/1996 | Menashe |
| 5,611,730 | A | 3/1997 | Weiss |
| 5,645,486 | A | 7/1997 | Nagao et al. |
| 5,655,961 | A | 8/1997 | Acres et al. |
| 5,674,128 | A | 10/1997 | Holch et al. |
| 5,707,286 | A | 1/1998 | Carlson |
| 5,759,102 | A | 6/1998 | Pease et al. |
| 5,762,552 | A | 6/1998 | Vuong et al. |
| 5,766,076 | A | 6/1998 | Pease et al. |
| 5,770,533 | A | 6/1998 | Franchi |
| 5,772,509 | A | 6/1998 | Weiss |
| RE35,864 | E | 7/1998 | Weingardt |
| 5,779,549 | A | 7/1998 | Walker et al. |
| 5,797,794 | A | 8/1998 | Angell |
| 5,800,268 | A | 9/1998 | Molnick |
| 5,816,918 | A | 10/1998 | Kelly et al. |
| 5,823,874 | A | 10/1998 | Adams |
| 5,823,879 | A | 10/1998 | Goldberg et al. |
| 5,830,063 | A | 11/1998 | Byrne |
| 5,830,069 | A | 11/1998 | Soltesz et al. |
| 5,842,698 | A | 12/1998 | Brown |
| 5,848,932 | A | 12/1998 | Adams |
| 5,851,011 | A | 12/1998 | Lott |
| 5,851,149 | A | 12/1998 | Xidos et al. |
| 5,855,515 | A | 1/1999 | Pease et al. |
| 5,876,284 | A | 3/1999 | Acres et al. |
| 5,885,158 | A | 3/1999 | Torango et al. |
| 5,909,486 | A | 6/1999 | Walker et al. |
| 5,941,773 | A | 8/1999 | Harlick |
| 5,971,271 | A | 10/1999 | Wynn et al. |
| 5,971,849 | A | 10/1999 | Falciglia |
| 5,997,400 | A | 12/1999 | Seelig et al. |
| 6,001,016 | A | 12/1999 | Walker et al. |
| 6,004,205 | A | 12/1999 | Lauretta et al. |
| 6,007,427 | A | 12/1999 | Wiener et al. |
| 6,012,982 | A | 1/2000 | Piechowiak et al. |
| 6,012,983 | A | 1/2000 | Walker et al. |
| 6,012,984 | A | 1/2000 | Roseman |
| 6,026,433 | A | 2/2000 | D'Arlach et al. |
| 6,039,648 | A | 3/2000 | Guinn et al. |
| 6,047,963 | A | 4/2000 | Pierce et al. |
| 6,077,162 | A | 6/2000 | Weiss |
| 6,089,977 | A | 7/2000 | Bennett |
| 6,089,980 | A | 7/2000 | Gauselmann |
| 6,102,474 | A | 8/2000 | Daley |
| 6,102,798 | A | 8/2000 | Bennett |
| 6,102,799 | A | 8/2000 | Stupak |
| 6,104,815 | A | 8/2000 | Alcorn et al. |
| 6,110,043 | A | 8/2000 | Olsen |
| 6,117,011 | A | 9/2000 | Lvov |
| 6,135,887 | A | 10/2000 | Pease et al. |
| 6,139,013 | A | 10/2000 | Pierce et al. |
| 6,142,872 | A | 11/2000 | Walker et al. |
| 6,146,273 | A | 11/2000 | Olsen |
| 6,149,522 | A | 11/2000 | Alcorn et al. |
| 6,155,925 | A | 12/2000 | Giobbi et al. |
| 6,158,741 | A | 12/2000 | Koelling |
| 6,159,097 | A | 12/2000 | Gura |
| 6,164,651 | A | 12/2000 | Webb |
| 6,168,523 | B1 | 1/2001 | Piechowiak et al. |
| 6,183,362 | B1 | 2/2001 | Boushy |
| 6,183,366 | B1 | 2/2001 | Goldberg et al. |
| 6,203,010 | B1 | 3/2001 | Jorasch et al. |
| 6,204,560 | B1 | 3/2001 | Daetwyler et al. |
| 6,206,374 | B1 | 3/2001 | Jones |
| 6,206,782 | B1 | 3/2001 | Walker et al. |
| 6,210,274 | B1 | 4/2001 | Carlson |
| 6,210,275 | B1 | 4/2001 | Olsen |
| 6,210,277 | B1 | 4/2001 | Stefan |
| 6,217,448 | B1 | 4/2001 | Olsen |
| 6,220,593 | B1 | 4/2001 | Pierce et al. |
| 6,224,482 | B1 | 5/2001 | Bennett |
| 6,224,484 | B1 | 5/2001 | Okuda et al. |
| 6,231,445 | B1 | 5/2001 | Acres |
| 6,254,483 | B1 | 7/2001 | Acres |
| 6,264,557 | B1 | 7/2001 | Schneier et al. |
| 6,264,561 | B1 | 7/2001 | Saffari et al. |
| 6,272,223 | B1 | 8/2001 | Carlson |
| 6,273,821 | B1 | 8/2001 | Moriguchi |
| 6,286,003 | B1 | 9/2001 | Muta |
| 6,308,953 | B1 | 10/2001 | Nagano |
| 6,309,299 | B1 | 10/2001 | Weiss |
| 6,312,332 | B1 | 11/2001 | Walker et al. |
| 6,315,660 | B1 | 11/2001 | DeMar et al. |
| 6,319,125 | B1 | 11/2001 | Acres |
| 6,319,127 | B1 | 11/2001 | Walker et al. |
| 6,334,104 | B1 | 12/2001 | Hirai |
| 6,336,859 | B2 | 1/2002 | Jones et al. |
| 6,336,862 | B1 | 1/2002 | Byrne |
| 6,345,824 | B1 | 2/2002 | Selitzky |
| 6,346,048 | B1 | 2/2002 | Ogawa et al. |
| 6,358,149 | B1 | 3/2002 | Schneider et al. |
| 6,361,441 | B1 | 3/2002 | Walker et al. |
| 6,364,768 | B1 | 4/2002 | Acres et al. |
| 6,375,567 | B1 | 4/2002 | Acres |
| 6,375,568 | B1 | 4/2002 | Roffman et al. |
| 6,402,618 | B1 | 6/2002 | Reed et al. |
| 6,406,371 | B1 | 6/2002 | Baba et al. |
| 6,409,602 | B1 | 6/2002 | Wiltshire et al. |
| 6,416,408 | B2 | 7/2002 | Tracy et al. |
| 6,416,409 | B1 | 7/2002 | Jordan |
| 6,422,940 | B1 | 7/2002 | Walker et al. |
| 6,431,983 | B2 | 8/2002 | Acres |
| 6,434,398 | B1 | 8/2002 | Inselberg |
| 6,435,968 | B1 | 8/2002 | Torango |
| 6,439,995 | B1 | 8/2002 | Hughs-Baird et al. |
| 6,454,650 | B1 | 9/2002 | Aronin |
| 6,482,089 | B2 | 11/2002 | DeMar et al. |
| 6,488,580 | B1 | 12/2002 | Robb |
| 6,503,146 | B2 | 1/2003 | Walker et al. |
| 6,506,117 | B2 | 1/2003 | DeMar et al. |
| 6,508,707 | B2 | 1/2003 | DeMar et al. |
| 6,508,709 | B1 | 1/2003 | Karmarkar |
| 6,508,710 | B1 | 1/2003 | Paravia et al. |
| 6,517,073 | B1 | 2/2003 | Vancura |
| 6,517,433 | B2 | 2/2003 | Loose et al. |
| 6,520,855 | B2 | 2/2003 | DeMar et al. |
| 6,523,124 | B1 | 2/2003 | Lunsford et al. |
| 6,560,639 | B1 | 5/2003 | Dan et al. |
| 6,589,115 | B2 | 7/2003 | Walker et al. |
| 6,592,460 | B2 | 7/2003 | Torango |
| 6,599,186 | B1 | 7/2003 | Walker et al. |
| 6,599,188 | B2 | 7/2003 | Hirsch et al. |
| 6,599,193 | B2 | 7/2003 | Baerlocher et al. |
| 6,648,753 | B1 | 11/2003 | Tracy et al. |
| 6,648,762 | B2 | 11/2003 | Walker et al. |
| 6,652,378 | B2 | 11/2003 | Cannon et al. |
| 6,692,354 | B2 | 2/2004 | Tracy et al. |
| 6,712,695 | B2 | 3/2004 | Mothwurf et al. |
| 6,712,699 | B2 | 3/2004 | Walker et al. |
| 6,733,390 | B2 | 5/2004 | Walker et al. |
| 6,749,510 | B2 | 6/2004 | Giobbi |
| 6,755,741 | B1 | 6/2004 | Rafaeli |
| 6,790,141 | B2 | 9/2004 | Muir |
| 6,805,634 | B1 | 10/2004 | Wells et al. |
| 6,837,788 | B2 | 1/2005 | Cannon |
| 6,837,793 | B2 | 1/2005 | McClintic |

(56) References Cited

U.S. PATENT DOCUMENTS

| | | | | |
|---|---|---|---|---|
| 6,860,810 | B2 | 3/2005 | Cannon et al. | |
| 6,869,361 | B2 | 3/2005 | Sharpless et al. | |
| 6,955,604 | B1 | 10/2005 | Graves et al. | |
| 6,986,055 | B2 | 1/2006 | Carlson | |
| 7,008,319 | B2 | 3/2006 | Montgomery et al. | |
| 7,083,520 | B2 | 8/2006 | Rowe | |
| 7,097,562 | B2 | 8/2006 | Gagner | |
| 7,169,041 | B2 | 1/2007 | Tessmer et al. | |
| 7,175,527 | B2 | 2/2007 | Bryant | |
| 7,192,351 | B2 | 3/2007 | Rozkin et al. | |
| 7,260,834 | B1 | 8/2007 | Carlson | |
| 7,311,598 | B2 | 12/2007 | Kaminkow et al. | |
| 7,311,604 | B2 | 12/2007 | Kaminkow et al. | |
| 7,347,775 | B2 | 3/2008 | Roemer | |
| 7,427,236 | B2 | 9/2008 | Kaminkow et al. | |
| 7,448,949 | B2 | 11/2008 | Kaminkow et al. | |
| 7,476,153 | B2 | 1/2009 | Walker et al. | |
| 7,662,040 | B2 | 2/2010 | Englman et al. | |
| 7,666,092 | B2 | 2/2010 | Kaminkow et al. | |
| 7,775,873 | B2 | 8/2010 | Aoki et al. | |
| 7,780,531 | B2 | 8/2010 | Englman et al. | |
| 7,833,094 | B2 | 11/2010 | Englman et al. | |
| 7,854,654 | B2 | 12/2010 | Baerlocher et al. | |
| 7,892,093 | B2 | 2/2011 | Kniesteadt et al. | |
| 7,931,530 | B2 | 4/2011 | Anderson et al. | |
| 7,963,847 | B2 | 6/2011 | Baerlocher | |
| 7,980,954 | B2 | 7/2011 | Gagner et al. | |
| 8,216,048 | B2 | 7/2012 | Cowan et al. | |
| 8,262,456 | B2 | 9/2012 | Englman et al. | |
| 8,292,731 | B2 | 10/2012 | Collette et al. | |
| 8,303,402 | B2 | 11/2012 | Aoki et al. | |
| 8,409,014 | B2 | 4/2013 | Gagner et al. | |
| 8,449,387 | B2 | 5/2013 | Englman et al. | |
| 2001/0004606 | A1 | 6/2001 | Tracy et al. | |
| 2001/0044339 | A1 | 11/2001 | Cordero et al. | |
| 2002/0002073 | A1 | 1/2002 | Montgomery et al. | |
| 2002/0006822 | A1 | 1/2002 | Krintzman | |
| 2002/0025845 | A1 | 2/2002 | Cannon | |
| 2002/0032049 | A1 | 3/2002 | Walker et al. | |
| 2002/0037767 | A1 | 3/2002 | Ebin | |
| 2002/0073043 | A1 | 6/2002 | Herman et al. | |
| 2002/0087876 | A1 | 7/2002 | Larose | |
| 2002/0107072 | A1 | 8/2002 | Giobbi | |
| 2002/0116615 | A1 | 8/2002 | Nguyen et al. | |
| 2002/0138594 | A1 | 9/2002 | Rowe | |
| 2002/0142846 | A1 | 10/2002 | Paulsen | |
| 2002/0147047 | A1 | 10/2002 | Letovsky et al. | |
| 2002/0151345 | A1 | 10/2002 | Byrne | |
| 2002/0151349 | A1 | 10/2002 | Joshi | |
| 2002/0155874 | A1 | 10/2002 | Byrne | |
| 2002/0163778 | A1 | 11/2002 | Hazzard et al. | |
| 2002/0183105 | A1 | 12/2002 | Cannon et al. | |
| 2003/0027618 | A1 | 2/2003 | Byrne | |
| 2003/0028567 | A1 | 2/2003 | Carlson | |
| 2003/0036430 | A1 | 2/2003 | Cannon | |
| 2003/0045337 | A1 | 3/2003 | Byrne | |
| 2003/0050106 | A1 | 3/2003 | Lyfoung | |
| 2003/0060258 | A1 | 3/2003 | Coleman et al. | |
| 2003/0064771 | A1 | 4/2003 | Morrow et al. | |
| 2003/0064776 | A1 | 4/2003 | Byrne | |
| 2003/0064805 | A1 | 4/2003 | Wells | |
| 2003/0064807 | A1* | 4/2003 | Walker et al. | 463/42 |
| 2003/0092485 | A1 | 5/2003 | Seelig et al. | |
| 2003/0100361 | A1 | 5/2003 | Sharpless et al. | |
| 2003/0114220 | A1 | 6/2003 | McClintic | |
| 2003/0119581 | A1 | 6/2003 | Cannon et al. | |
| 2003/0148804 | A1 | 8/2003 | Ikeya et al. | |
| 2003/0148807 | A1 | 8/2003 | Acres | |
| 2003/0148808 | A1 | 8/2003 | Price | |
| 2003/0162589 | A1 | 8/2003 | Nguyen et al. | |
| 2003/0181231 | A1 | 9/2003 | Vancura et al. | |
| 2003/0186733 | A1 | 10/2003 | Wolf et al. | |
| 2003/0195043 | A1 | 10/2003 | Shinners et al. | |
| 2003/0216166 | A1 | 11/2003 | Baerlocher et al. | |
| 2003/0222402 | A1 | 12/2003 | Olive | |
| 2003/0224852 | A1 | 12/2003 | Walker et al. | |
| 2003/0228899 | A1 | 12/2003 | Evans | |
| 2003/0236116 | A1 | 12/2003 | Marks et al. | |
| 2004/0009808 | A1 | 1/2004 | Gauselmann | |
| 2004/0009811 | A1 | 1/2004 | Torango | |
| 2004/0030654 | A1 | 2/2004 | Walker et al. | |
| 2004/0038741 | A1 | 2/2004 | Gauselmann | |
| 2004/0048644 | A1 | 3/2004 | Gerrard et al. | |
| 2004/0053657 | A1 | 3/2004 | Fiden et al. | |
| 2004/0055113 | A1 | 3/2004 | Fiden et al. | |
| 2004/0102243 | A1 | 5/2004 | Olsen | |
| 2004/0106448 | A1 | 6/2004 | Gauselmann | |
| 2004/0204226 | A1 | 10/2004 | Foster et al. | |
| 2004/0204235 | A1 | 10/2004 | Walker et al. | |
| 2004/0209660 | A1 | 10/2004 | Carlson et al. | |
| 2004/0235552 | A1 | 11/2004 | Gauselmann | |
| 2004/0242297 | A1 | 12/2004 | Walker et al. | |
| 2004/0242303 | A1 | 12/2004 | Walker et al. | |
| 2004/0248651 | A1 | 12/2004 | Gagner | |
| 2005/0014554 | A1 | 1/2005 | Walker et al. | |
| 2005/0020340 | A1 | 1/2005 | Cannon | |
| 2005/0026674 | A1 | 2/2005 | Wolf et al. | |
| 2005/0055113 | A1 | 3/2005 | Gauselmann | |
| 2005/0124406 | A1 | 6/2005 | Cannon | |
| 2005/0130730 | A1 | 6/2005 | Lind et al. | |
| 2005/0192086 | A1 | 9/2005 | Walker et al. | |
| 2005/0193209 | A1 | 9/2005 | Saunders et al. | |
| 2005/0282605 | A1 | 12/2005 | Englman | |
| 2006/0019734 | A1 | 1/2006 | Roemer | |
| 2006/0019744 | A1 | 1/2006 | Roemer | |
| 2006/0040732 | A1 | 2/2006 | Baerlocher et al. | |
| 2006/0079318 | A1 | 4/2006 | Aoki et al. | |
| 2006/0079319 | A1 | 4/2006 | Aoki et al. | |
| 2006/0084486 | A1 | 4/2006 | Belger et al. | |
| 2006/0121971 | A1 | 6/2006 | Slomiany et al. | |
| 2006/0135243 | A1 | 6/2006 | Englman | |
| 2006/0160625 | A1 | 7/2006 | Englman | |
| 2006/0165235 | A1 | 7/2006 | Carlson | |
| 2006/0223611 | A1 | 10/2006 | Baerlocher | |
| 2008/0020847 | A1 | 1/2008 | Kniesteadt et al. | |
| 2008/0045341 | A1 | 2/2008 | Englman | |
| 2008/0070702 | A1 | 3/2008 | Kaminkow et al. | |
| 2008/0081690 | A1 | 4/2008 | Baerlocher et al. | |
| 2008/0113771 | A1 | 5/2008 | Baerlocher et al. | |
| 2008/0139290 | A1 | 6/2008 | Kniesteadt et al. | |
| 2008/0153564 | A1 | 6/2008 | Baerlocher et al. | |
| 2009/0093298 | A1 | 4/2009 | Michel | |
| 2009/0124327 | A1* | 5/2009 | Caputo et al. | 463/20 |
| 2009/0124366 | A1 | 5/2009 | Aoki et al. | |
| 2009/0305765 | A1 | 12/2009 | Walker et al. | |
| 2010/0004055 | A1* | 1/2010 | Gormley et al. | 463/25 |
| 2010/0137047 | A1 | 6/2010 | Englman et al. | |
| 2010/0137056 | A1* | 6/2010 | Hoffman | G07F 17/32 463/21 |
| 2010/0197385 | A1 | 8/2010 | Aoki et al. | |
| 2010/0291991 | A1 | 11/2010 | Baerlocher et al. | |
| 2010/0304843 | A1 | 12/2010 | Aoki et al. | |
| 2011/0053683 | A1 | 3/2011 | Aoki et al. | |
| 2011/0105233 | A1 | 5/2011 | Aoki | |
| 2011/0312410 | A1 | 12/2011 | Aoki et al. | |
| 2013/0116028 | A1 | 5/2013 | Aoki et al. | |

FOREIGN PATENT DOCUMENTS

| | | | |
|---|---|---|---|
| DE | 196 24 321 | A1 | 1/1998 |
| EP | 0507435 | | 10/1992 |
| EP | 0 521 599 | A1 | 1/1993 |
| EP | 0829834 | A2 | 3/1998 |
| EP | 0843272 | A1 | 5/1998 |
| EP | 1 513 114 | A2 | 3/2005 |
| EP | 1 564 698 | A2 | 8/2005 |
| EP | 1 762 990 | A2 | 3/2007 |
| GB | 2117546 | | 10/1983 |
| GB | 2148037 | | 5/1985 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | | 8/1999 |

(56) References Cited

FOREIGN PATENT DOCUMENTS

| | | | |
|---|---|---|---|
| WO | WO 97/27569 | | 7/1997 |
| WO | WO 99/03078 | A1 | 1/1999 |
| WO | WO 99/19037 | A1 | 4/1999 |
| WO | WO 01/91866 | | 2/2001 |
| WO | WO 01/33478 | A1 | 5/2001 |
| WO | WO 03/026754 | A1 | 4/2003 |
| WO | WO 03/083789 | A1 | 10/2003 |
| WO | WO 2004/034223 | A2 | 4/2004 |
| WO | WO 2006/015442 | A1 | 2/2006 |
| WO | WO 2009/114472 | A1 | 9/2009 |

OTHER PUBLICATIONS

Article for "Easy Riches" by Sigma Game, Strictly Slots, 1 page (Aug. 2001).
Article for "Millioniser" by Glenn Haussman, Strictly Slots, pp. 50-53 (Mar. 2004).
International Search Report corresponding to International Patent Application No. PCT/US2008/005032, United States Patent Office, dated Aug. 11, 2008, 4 pages.
International Search Report corresponding to International Patent Application No. PCT/US2008/012433, United States Patent Office, dated Jan. 2, 2009, 5 pages.
"New '97 Games," International Gaming & Wagering Business, 24 pages (Mar. 1997).
Product Sheet for "Big Games Safari," IGT, 24 pages (2000).
"The Silicon Gaming Odyssey Slot Machine" (Levinthal,, et al., pp. 296 to 301, 1063-6390/97, © IEEE, Proceedings of COMPCON 97).
Written Opinion corresponding to co-pending International Patent Application Serial No. PCT/US2008/005032, European Patent Office; dated Aug. 11, 2008; 6 pages.
Written Opinion corresponding to International Patent Application No. PCT/US2008/012433, United States Patent Office, dated Jan. 2, 2009, 2 pages.

* cited by examiner

SYSTEMS, METHODS AND DEVICES FOR PLAYING WAGERING GAMES WITH DISTRIBUTED COMPETITION FEATURES

CLAIM OF PRIORITY AND CROSS-REFERENCE TO RELATED APPLICATIONS

This application claims the benefit of and priority to U.S. Provisional Patent Application No. 61/674,125, which was filed on Jul. 20, 2012, and U.S. Provisional Patent Application No. 61/618,983, which was filed on Apr. 2, 2012, both of which are incorporated herein by reference in their respective entireties.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and gaming systems. More particularly, the present disclosure relates to systems, methods, and devices for playing wagering games with competition features that are played amongst multiple players.

BACKGROUND

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Thus, gaming manufacturers continuously strive to develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "primary" or "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio.

Another concept that has been employed is the use of progressive jackpots. In the gaming industry, a "progressive jackpot" involves collecting coin-in data from participating gaming device(s) (e.g., slot machines), contributing a percentage of that coin-in data to a jackpot amount, and awarding that jackpot amount to a player upon the occurrence of a jackpot-winning event. A jackpot-winning event typically occurs when a "progressive winning position" is achieved at a participating gaming device. If the gaming device is a slot machine, a progressive winning position may, for example, correspond to alignment of progressive jackpot reel symbols along an active payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate.

Game play, whether it is a basic game, a bonus game, or progressive gaming, is typically a function of player activity at a single gaming terminal. Consequently, individual players are rarely interested in game play of other players at other gaming terminals, especially those that are not within view. Recent enhancements to available gaming features, such as community gaming events, allow players to share in gaming activities with other gaming terminals. For example, game play of a community game at one gaming terminal in a bank of terminals may influence game play of the community game at another gaming terminal within that terminal bank. Providing shared gaming experiences allows players to participate in an arena larger than his or her personal gaming terminal. Additional information regarding community gaming can be found, for example, in commonly owned U.S. Patent Application Publication No. 2010/0317442 A1, to Alfred Thomas et al., which published on Dec. 16, 2010, and is incorporated herein by reference in its entirety and for all purposes.

Interactive online gaming allows players to gamble from locations remote from a casino. For example, a player may access a gaming web site on a global computer network, such as the Internet, from a computing device coupled to the global computer network. The computing device may, for example, be a personal computer, Internet appliance, personal digital assistant (PDA), or wireless telephone (i.e., "cell phones"). To play a wagering game on the gaming web site, a player generally must supply credit or debit card account information. Wagers are deducted from the account, and payouts for winning outcomes are added to the account. Additional information regarding online gaming can be found, for example, in commonly owned U.S. Pat. No. 7,722,466 B2, to Wayne H. Rothschild, which issued on May 25, 2010, and is incorporated herein by reference in its entirety and for all purposes.

While some current game features provide some enhanced excitement, there is still a need for additional concepts to enhance the entertainment value of electronic wagering games, such as slots, keno, poker, and blackjack. Although a lot of focus is now being paid to enhancing bonus games, there is still room for improving aspects of the basic wagering game. Such new features for wagering games will further enhance player excitement, perpetuate player loyalty, and thus increase game play and profitability.

SUMMARY

Aspects of the present disclosure are directed to wagering games with a head-to-head game play feature that allows a player to achieve more advantageous game outcomes by competing with and capitalizing on their network of friends. For instance, competitive multi-player gaming is provided and incentivized by causing a triggered feature, such as a start-bonus-game outcome in a base wagering game, to offer the player the opportunity to send out challenges, for example, over a social network or other gaming network. The challenge offers the initial "sending" player the ability to increase the payout associated with the feature by defeating the secondary "recipient" player(s) in head-to-head game play and/or tournament play. Optionally, the secondary player(s) may be incentivized to accept the challenge by offering them the ability to play the feature for free, by offering the ability to play features that they may not otherwise be eligible to play, or by offering the ability to win awards associated with the feature.

According to one aspect of the present disclosure, a gaming system for playing a wagering game is disclosed. The gaming system includes one or more processors and one or more memory devices. The memory device(s) stores instructions that, when executed by at least one of the one or more processors, cause the gaming system to: display, via at least one of one or more display devices, a randomly determined outcome of the wagering game to a first player; in response to a triggering event during play of the wagering game, transmit an offer to participate in a competitive gaming feature to at least a second player; randomly determine a first final outcome of the competitive gaming feature for the first player; randomly determine a second final outcome of the competitive gaming feature for the second player; and, in response to a valuation of the first final outcome being better than a valuation of the second final outcome, award an award associated with the competitive gaming feature to the first player.

Other aspects of the present disclosure are directed to a computer-implemented method of conducting a wagering game on a gaming system. The method includes: receiving an indication of a wager to play the wagering game; randomly determining an outcome of the wagering game for a first player; transmitting an offer to participate in a competitive gaming feature to at least a second player; randomly determining, via at least one of one or more processors, a first final outcome of the competitive gaming feature for the first player; randomly determining, via at least one of the one or more processors, a second final outcome of the competitive gaming feature for the second player; and, in response to a valuation of the first final outcome being better than a valuation of the second final outcome, awarding an award associated with the competitive gaming feature to the first player.

In accordance with another aspect of the disclosure, one or more physical machine-readable storage media are featured which include instructions which, when executed by one or more processors, cause the one or more processors to perform operations comprising: receive an indication of a wager to play the wagering game; randomly determine an outcome of the wagering game for a first player; transmit an offer to participate in a competitive gaming feature to at least a second player; randomly determine a first final outcome of the competitive gaming feature for the first player; randomly determine a second final outcome of the competitive gaming feature for the second player; and, in response to a valuation of the first final outcome being better than a valuation of the second final outcome, award an award associated with the competitive gaming feature to the first player.

Another aspect of this disclosure is directed to a gaming system for conducting a wagering game on a gaming device with at least one input device and at least one display device. The gaming system includes one or more processors and one or more memory devices storing instructions that, when executed by at least one of the one or more processors, cause the gaming system to: receive an indication of a wager from a first player via the at least one input device of the gaming device to play a base game of the wagering game; display a randomly determined outcome of the base game of the wagering game to the first player via the at least one display device of the gaming device; in response to a triggering event in the outcome of the base game of the wagering game and a command received from the first player, transmit an offer to compete in a competitive gaming feature to a plurality of secondary players; randomly determine a first final outcome of the competitive gaming feature for the first player; in response to one or more of the secondary players selecting to compete in the competitive gaming feature, randomly determine, separate from one another and from the random determination of the first final outcome, a respective second final outcome of the competitive gaming feature for each of the secondary players who elected to compete in the competitive gaming feature; determine a valuation of the first final outcome and a respective valuation of each of the respective second final outcomes; and, in response to each instance where the valuation of the first final outcome is better than the respective valuation of one of the respective second final outcomes, award an award associated with the competitive gaming feature to the first player.

Yet another aspect of this disclosure presents a method of conducting a wagering game on a gaming system. The method includes: receiving an indication of a wager from a first player to play a base game of the wagering game; randomly determining an outcome of the base game of the wagering game for the first player; in response to a triggering event in the outcome of the base game of the wagering game and a command received from the first player, transmitting an offer to compete in a competitive gaming feature to a plurality of secondary players; randomly determining, via at least one of one or more processors, a first final outcome of the competitive gaming feature for the first player; in response to one or more of the secondary players selecting to compete in the competitive gaming feature, randomly determining, via at least one of the one or more processors and separate from one another and from the random determination of the first final outcome, a respective second final outcome of the competitive gaming feature for each of the secondary players who elected to compete in the competitive gaming feature; determining a valuation of the first final outcome and a respective valuation of each of the respective second final outcomes; and, in response to each instance where the valuation of the first final outcome is better than the valuation of one of the respective second final outcomes, awarding an award associated with the competitive gaming feature to the first player.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and modes for carrying out the present invention when taken in connection with the accompanying drawings and the appended claims.

Figure 1:
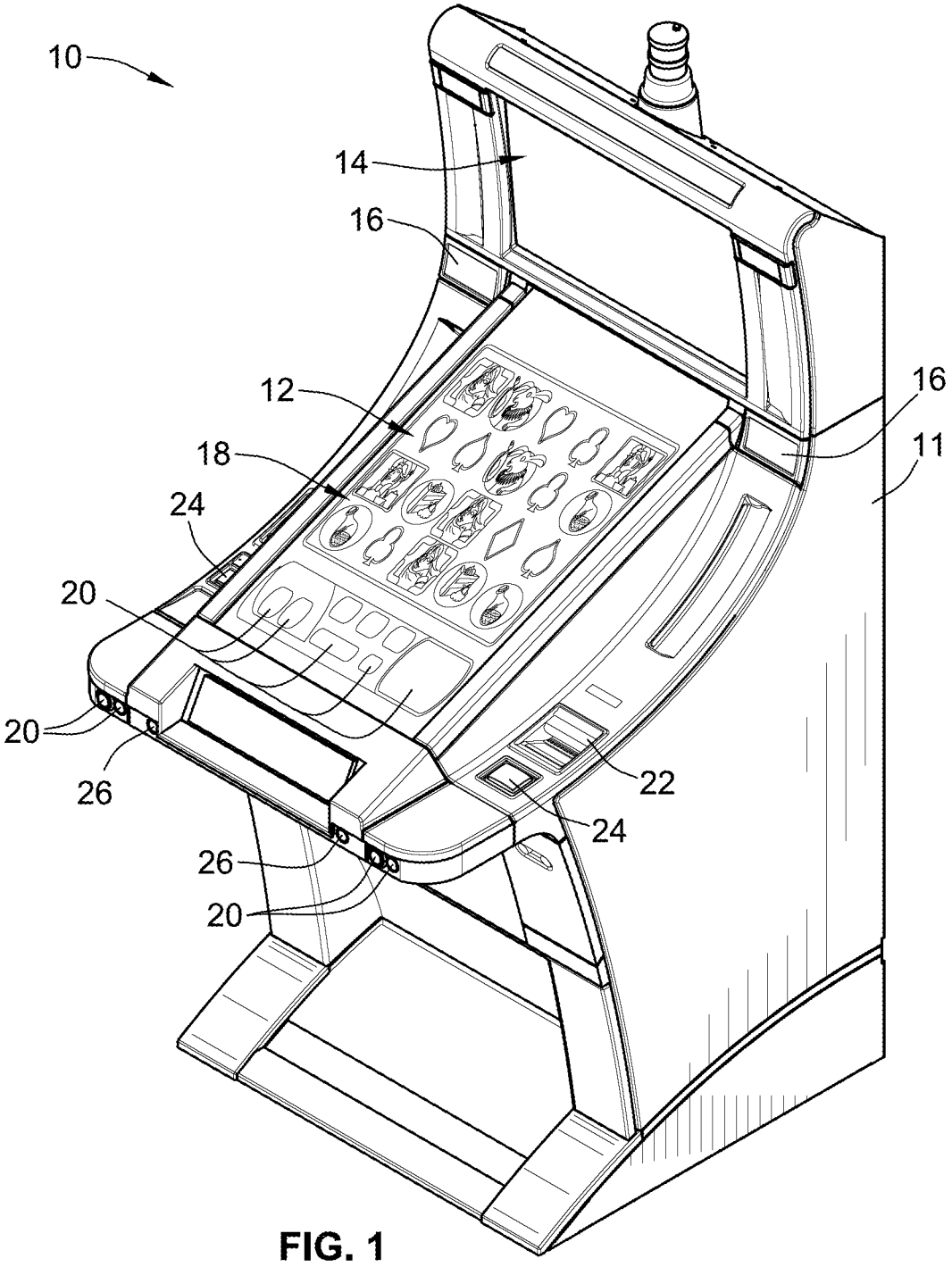
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

This invention is susceptible of embodiment in many different forms. There are shown in the drawings and will herein be described in detail representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring to the drawings, wherein like reference numerals refer to like features throughout the several views, there is shown in FIG. 1 a representative gaming terminal 10 similar to those used in gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 is an electromechanical gaming terminal configured to play slots with mechanical reels, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models (as shown), handheld mobile devices, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, U.S. Patent Application Publication Nos. 2010/0062196 and 2010/0234099, and International Application No. PCT/US2007/000792, all of which are incorporated herein by reference in their respective entireties for all purposes.

The gaming terminal 10 illustrated in FIG. 1 comprises a cabinet 11 that may house various input devices, output devices, and input/output devices. By way of non-limiting example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display may be disposed in front of the mechanical-reel display to portray a video image superimposed upon the mechanical-reel display. The display areas may variously display information associated with wagering games, non-wagering games, community games, progressive games, advertisements, services, premium entertainment, text messaging, emails, alerts, announcements, broadcast information, subscription information, etc., appropriate to the particular mode(s) of operation of the gaming terminal 10. The gaming terminal 10 includes a touch screen(s) 18 mounted over the primary and/or secondary areas 12, 14, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals can be selected from a group consisting essentially of an electrical current, an electrical voltage, an electrical charge, an optical signal, an optical element, a magnetic signal, and a magnetic element.

Figure 2:
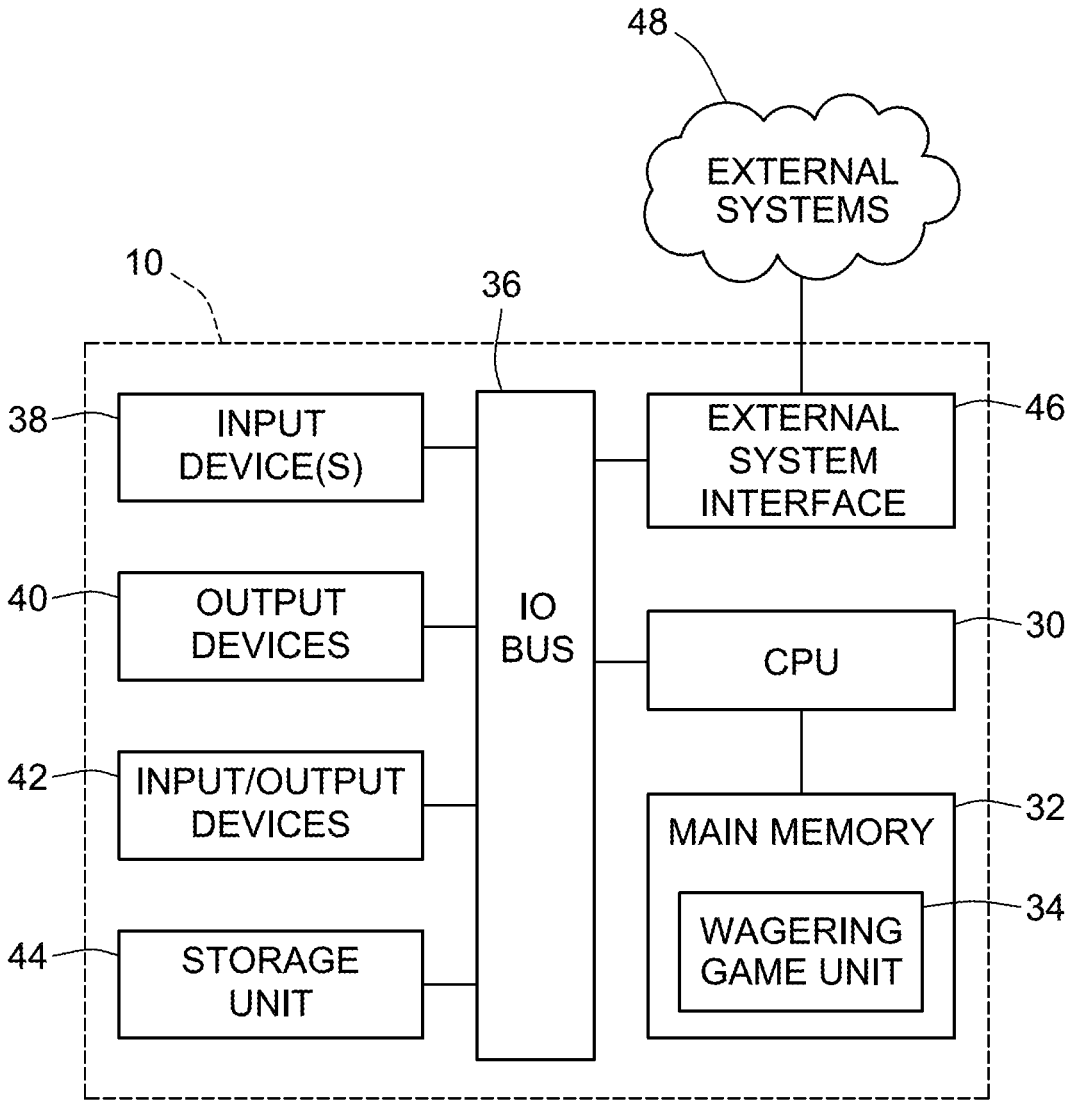
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes a random number generator (RNG) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
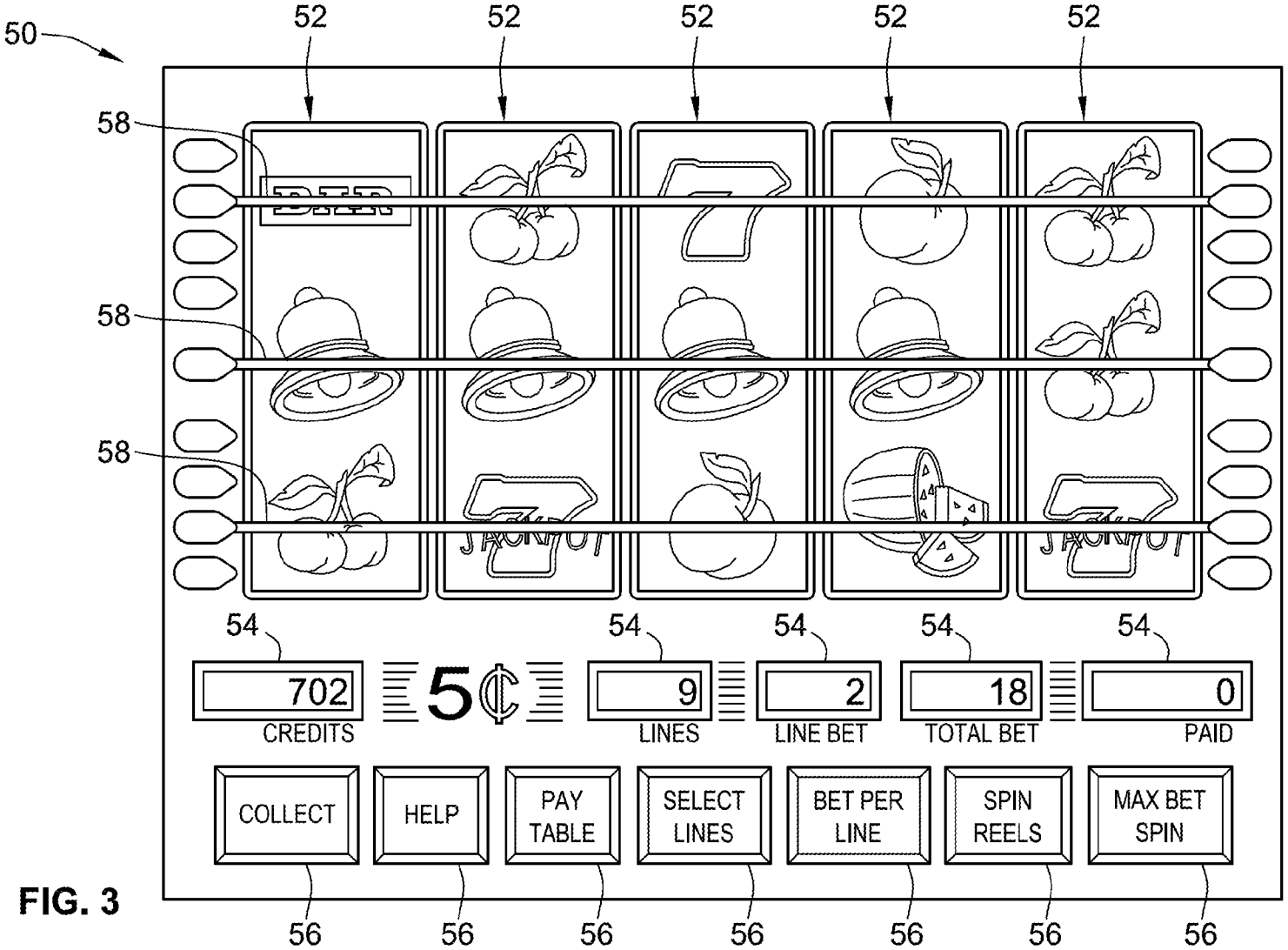
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by an RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
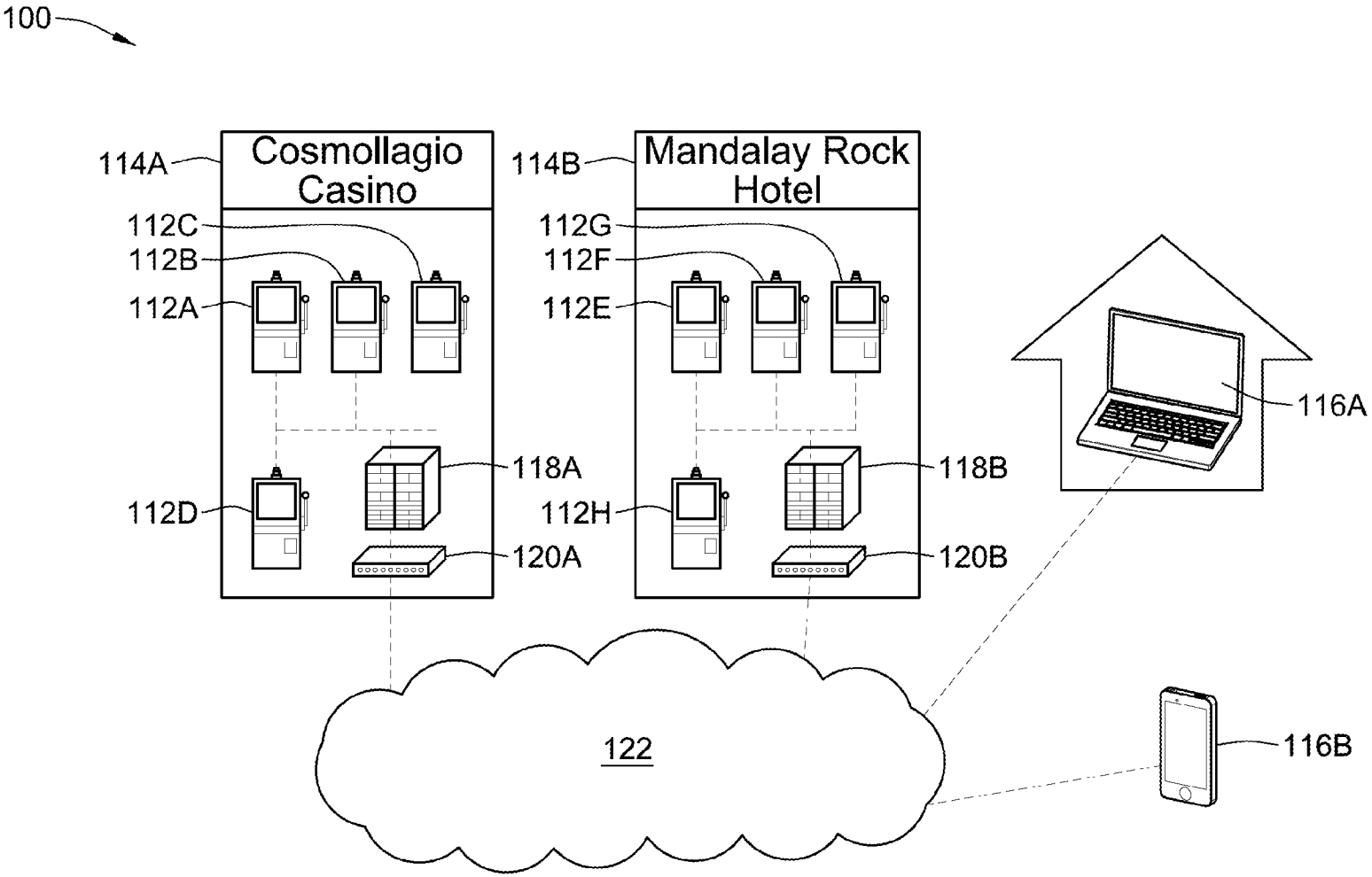
FIG. 4 is a diagrammatic illustration of a representative gaming system and network in accordance with aspects of the present disclosure.

FIG. 4 is a diagrammatic illustration of a representative gaming system and network with which aspects of the disclosed concepts can be practiced. The gaming system and network, which are collectively designated 100 in the drawings, may be a web-based system for integrating casino gaming with non-casino interactive gaming, and vice versa. As shown, the gaming system and network 100 includes a first plurality of gaming terminals 112A-D located in a first "land-based" gaming establishment 114A (e.g., the "Cosmollagio Casino"), and a second plurality of gaming terminals 112E-H located in a second "land-based" gaming establishment 114B (e.g., the "Mandalay Rock Hotel"). Also included are a variety of personal computing devices, represented herein by a laptop computer 116A and a mobile phone with a built-in mobile computing platform (or "smartphone") 116B, which are remote from either of the gaming establishments 114A and 114B. Each of the gaming establishments 114A-B utilizes a local "casino" server 118A and 118B, respectively, which is communicatively coupled to a corresponding communications hub 120A, 120B. The local servers 118A-B individually, collectively and/or in collaboration with an offsite central server system (not shown), can offer a plurality of wagering games in such categories as slots, poker, bingo, keno, and blackjack, just to name a few examples.

The land-based gaming establishments 114A-B, including one or more of the gaming terminals 112A-H, are shown linked to the personal computing devices 116A-B by a reconfigurable, multi-site computer network, such as an intranet 122. The personal computing devices 116A-B, which are remote from any land-based gaming establishment, may communicatively connect, with proper authorization, to one or more of the local servers 118A-B and/or gaming terminals 112A-H via the intranet 122. In so doing, one or more of the wagering games that are available on the local servers 118A-118B may be conducted via either the gaming terminals 112A-H and/or or the personal computing devices 116A-B. Although differing in appearance, the gaming terminals 112A-H can be similar in function and connectivity to the gaming terminal 10 discussed above with respect to FIGS. 1 and 2. The gaming terminals 112A-H of FIG. 4 can take on various configurations, including free standing gaming machines, handheld gaming machines, countertop gaming machines, personal computers or laptop computers, or any combination thereof.

The intranet 122 may be a network based on TCP/IP (Transmission Control Protocol/Internet Protocol) protocols belonging to an organization, usually a corporation, accessible only by the organization's members, employees, and/or others with proper authorization. In the illustrated system, the intranet can be used to securely network the gaming terminals 112A-H to a local casino server 118A-B and other terminals, both inside and outside of their respective establishments 114A-B. Each of the local servers 118A-B can operate an intranet web site and post wagering games on the web site. The web site can include a firewall to fend off unauthorized access. With proper authorization, the non-casino-based personal computing devices 116A-B may access the web page(s) via the internet 122 and thereby link to the local casino servers 118A-118B and even the gaming terminals 112A-H. As will be developed in further detail below, the internet 122 can also be used for the individual gaming terminals 112A-H to transmit gaming features to each other and to the personal computing devices 116A-B.

When a wagering game is conducted via one of the gaming terminal 112A-H, the wagering game may be conducted at a server level, a terminal level, or a hybrid server/terminal level depending, for example, upon how the machine and the system are set up. Likewise, when a wagering game is conducted via one of the personal computing device 116A-B, the wagering game may be conducted at a server level or a hybrid server/device level depending, for example, upon how the device and the system are set up. When the wagering game is conducted at the server level, the game's audiovisual content and game software are executed, for example, at one of the local casino servers 118A-118B. In this case, the gaming terminals 112A-H and/or personal computing devices 116A-B need not include a game engine for executing the game software and primarily serve as a display device. To allow the terminals 112A-H and/or computing devices 116A-B to execute the audiovisual content and game software, this information is downloaded from a local casino server 118A-B to the terminal 112A-H or device 116A-B and stored locally prior for conducting the wagering game. When the wagering game is conducted at the hybrid level, the audiovisual content is executed at the terminal 112A-H or device 116A-B while the game software is executed at the server 118A-118B. To allow the terminal 112A-H or device 116A-B to execute the audiovisual content, the audiovisual content is downloaded from the server 118A-118B and stored locally on the gaming device prior to conducting the wagering game. In order to make wagering games conducted via a computing device 116A-B verifiable, it may be required that the random event be generated at the server 118A-B. Thus, in some embodiments, wagering games may not be conducted solely at the device level.

The gaming terminals 112A-H can also be networked to each other and a server 118A-B by the intranet 122. The gaming terminals 112A-H in each land-based gaming establishment 114A-B can be linked by a high-speed local area network, such as a wireless or wired Ethernet. Each local area network can be configured to support standard Internet protocols, such as TCP/IP, for transmitting data over the local area network and transmitting data between the local area network and a local system 118A-B. The local casino server 118A-B may include a gateway that serves as an entrance to the local area network. The gateway can be associated with a router, which knows where to direct a given packet of data that arrives at the gateway, and a switch, which furnishes the actual path in and out of the gateway for a given packet. The communications hub 120A-B can consolidate data transferred to and from the gaming terminals 112A-H. A workstation (not shown) may be used to program, control, and monitor the gaming terminals 112A-H at the local casino level.

Figure 5:
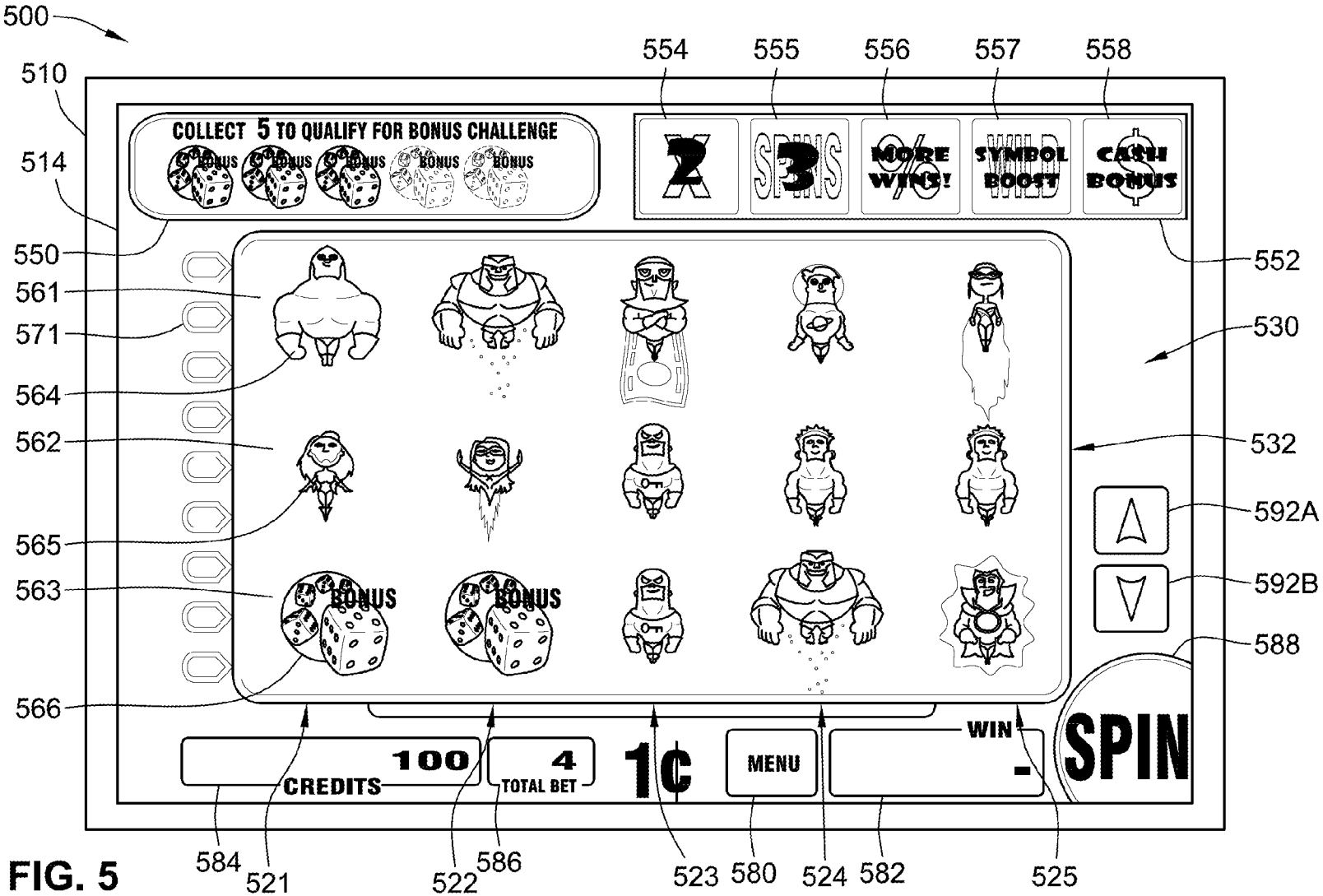
FIG. 5 is a screen shot of a display device displaying an exemplary wagering game with a distributed competition feature in accordance with aspects of the present disclosure.

FIG. 5 is a screen shot of a game screen from an exemplary wagering game in accordance with aspects of the present disclosure. A primary display 514 of a gaming device or terminal 510, which may be part of an exemplary gaming system 500, is shown is FIG. 5. The gaming system 500 may be similarly configured to the gaming systems shown in FIGS. 2 and 4. The gaming terminal 510 of FIG. 5 can take on various alternative configurations, including, without limitation, upright freestanding gaming machines, slant-top freestanding gaming machines, handheld and portable gaming machines, countertop gaming machines, personal computers and laptop computers, or other known gaming devices, individually or in any combination thereof. The primary display device 514 of the gaming terminal 510 displays wagering games, such as those described above with respect to FIGS. 1-3 or those described below with respect to FIGS. 4-8, for example. The display device 514 may be any form of display, such as those described with reference to the free-standing gaming terminal 10 of FIG. 1. For instance, the primary display 514 may comprise a plasma, LED, OLED, LCD, CRT, projection, or any other now-known or later-developed display device. Although numerous aspects of the wagering game 530 are all shown displayed on a single display device (i.e., the primary display 514), these aspects are not so limited and can be displayed in any combination on any number of display devices unless otherwise expressly prohibited.

The display device 514 displays or otherwise visually depicts a wagering game 530, which in this example is the slot game shown in FIG. 5. The slot game 530 includes a plurality of symbol-bearing reels, designated generally as 521-525, respectively, each having a plurality of distinct symbol positions (collectively represented by the three symbol positions 561-563 in the symbol array 532) and bearing a number of symbols (collectively represented by three symbols 564-566 in the symbol array 532). The symbols may include any variety of graphical symbols, emblems, elements, or representations, including symbols that are associated with one or more themes of the gaming terminal 510 and gaming system 500 (e.g., a Super Duper Heroes theme). The symbols may also include a blank symbol or empty space. The symbols on the reels 521-525 are arranged in an array 532, which in this embodiment is a 3×5 matrix (i.e., three rows by five columns) of symbols. The reels 521-525 are varied (e.g., spun and stopped) to reveal combinations of symbols in the array 532, which represent randomly selected outcomes of the wagering game 530, that are evaluated for winning symbol combinations. Winning combinations of symbols landing, for example, on activated paylines (e.g., those paylines for which a wager has been received), cause awards to be paid in accordance with one or more pay tables associated with the gaming system 500.

Within the scope of this disclosure, the wagering game 530 can include greater or fewer than five symbol-bearing reels (simulated, mechanical, or otherwise) and, in some embodiments, greater or fewer symbol positions than those shown in FIG. 5. In this regard, the randomly selected outcomes may comprise greater or fewer than 15 symbols, and may take on a variety of different forms having greater or fewer rows and/or columns. The matrix may even comprise other non-rectangular forms or arrangements of symbols. Moreover, the randomly selected outcomes of the wagering game 530 may be varied from the representation provided in FIG. 5. Likewise, the Super Duper Heroes game theme is purely illustrative and non-limiting in nature.

The primary display 514 further includes certain display features for providing information and options to a player. For example, the display 514 features may include a MENU button 580, a WIN meter 582, a CREDITS meter 584, and a TOTAL BET meter 586. The MENU button 480 can be pressed and activated (e.g., through an overlying touch screen) by a player desiring to access other control menus, preferences, help screens, informational menus, etc. For example, the player can change a theme of the wagering game 530 via the MENU button 580, or change the type of the wagering game (e.g., to video poker, keno, etc.). The WIN meter 582 displays to the player the amount of the total win (if any) from the most recent play of the wagering game 530. The CREDITS meter 584 displays to the player the total amount of credits (if any) remaining and available to the player for play of the wagering game 530. The TOTAL BET meter 586 displays to a player the current size of his/her wager (in credits). Once a number of paylines are selected and a wager is placed, a SPIN button 588 can be pressed or otherwise activated by a player to effectuate rotation of the reels 521-525. In an optional configuration, selection of a SPIN button will effectuate rotation of the reels 521-525 without requiring prior selection of a wager and/or a number of paylines (e.g., a default wager and a default number of payline(s) are automatically chosen upon selection of the SPIN button).

Fewer, additional, or alternative display features may be included for presenting information and/or options to a player. In one specific instance, a row of player-selectable LINES buttons can be provided to give players the option of quickly selecting and activating a predetermined number of paylines (e.g., 1, 5, 9, 20 or 40 lines). Another option would be to display a row of player-selectable PER LINE buttons, which gives a player the option of quickly selecting a predetermined bet per payline (e.g., 1, 2, 3, 5 and 10 credits per activated payline). The primary display 514 can also include, for example, an optional CHANGE DENOM button that can be activated to change the denomination of wagers (e.g., from 1¢ per credit to 25¢ per credit) which the player is inputting into the system 500. Other features may include, in some non-limiting examples, one or more bet change buttons 592A and 592B that permit a player to incrementally increase and/or decrease the size of his/her wager, a MAX BET SPIN button (not shown) for wagering a maximum number of credits and contemporaneously varying the reels of the wagering game 430, as well as any of the other buttons and meters presented herein or other features now known or hereinafter developed.

The wagering game 530 is shown in FIG. 5 after play of a base game (or bonus game) segment is initiated, for example, by the player providing a wager, e.g., responsive to an input via at least one input device, and thereafter pressing a spin button or pulling a spin lever. The monetary wager, which is typically a selected number of credits, is deducted from the available credits, e.g., the 100 credits displayed via the CREDITS meter 584 in FIG. 5. The monetary wager that is in play (e.g., 4 credits in FIG. 5) can be displayed via the TOTAL BET meter 586. The reels 521-525 may then be varied (e.g., spun and stopped); the reels 521-525 continue to spin until they are stopped to reveal in the symbol array 532 symbols which represent a randomly selected outcome of the wagering game 530. The wagering-game outcome is, according to some aspects, randomly determined from a plurality of potential wagering-game outcomes. As indicated above, each outcome is evaluated for winning symbol combinations to determine if the displayed outcome has one or more awards associated therewith.

A local controller (e.g., CPU 30 of FIG. 2), a host system (e.g., external system 48 of FIG. 2), a central controller, or any combination thereof, in alternative embodiments, operates to execute the wagering game program causing the display area 514 to display selected portions of the wagering game 530. An outcome of the wagering game can be randomly selected from a plurality of potential wagering-game outcomes (e.g., using a local random number generator (RNG)). The wagering-game outcome is then revealed, displayed, or otherwise communicated to the player, for example, on a corresponding display device 514. The game screen 514 displays the wagering-game outcome by portraying the plurality of simulated reels 521-525 spinning and stopping to reveal a plurality of symbols arranged in a 3-row, 5-column matrix—i.e., symbol array 532. A winning combination occurs, for example, when the displayed symbols correspond to one or more of the winning symbol combinations listed in a predetermined pay table. In response, a wagering-game prize (e.g., a monetary award) associated with a winning outcome is conferred upon the player.

Embodiments of the present disclosure include a SLOT SHOTS feature which offers competitive multi-player game play to achieve more advantageous game outcomes. SLOT SHOTS, in at least some embodiments, is a slots-style social gaming feature with a focus on head-to-head slot play and tournament-based game play. Social gaming is dramatically expanding the gaming industry's consumer base. In the wagering game industry, social gaming typically refers to gaming environments which allow multiple players to play wagering games as a way of social interaction, as opposed to individual players playing a game in isolation. Many social network games are played over the Internet and are available as turn-based models that are seamlessly integrated into widely popular social networking websites, such as Facebook® and Twitter®. Social network games are most often implemented as "browser games," played on a personal computer over the Internet with a web browser employing standard web technologies or browser plugins. Social network games can also be implemented on other platforms, such as mobile devices, personal digital assistants (PDA), and mobile tablet devices. Even though social network games are often played via a web browser, they are distinct from traditional "browser games," for example, by leveraging a player's social graph and individual user data that is hosted on a particular social network website.

Some embodiments of the present disclosure leverage online social gaming environments to execute slot-based content (or other wagering-game content) which incorporates features that provide a player with the ability to use their social network to compete against multiple players in a wagering game. Through a social network, for example, the player can garner additional chances to achieve a winning game outcome by allowing the player to distribute challenges through their social network to compete with one or more network "friends." Each accepted challenge provides the distributing player with an additional opportunity to compete in a head-to-head game play feature and potentially win an award. In an example of a "winner takes all" game configuration, each player tries to amass the largest credit earnings, e.g., in a series of sequential spins of a slot game, and the player with the largest earnings is awarded both players winnings. Optionally, the challenge may be to compete in a multi-player tournament where a single overall winner of the tournament wins most/all of the tournament credit earnings.

According to one exemplary configuration, the standard game-play loop includes a first player playing a base-game portion of a slot game. While playing, the first player amasses a number of "enhancements" that are saved for and applied to future spins in a bonus round of the slot game. During a bonus round, the first player can strategically apply the enhancements to the spins they choose to achieve, for example, the highest available payouts. At the initiation of the bonus round, the first player is provided with the option to choose a friend (or several friends) to challenge. The friend(s) receives notification of the challenge and, if accepted within a specific time window, they then play in competitive wagering game feature, such as a winner-takes-all bonus spin match. By accepting the challenge, the receiving player automatically receives one or more random or predetermined enhancements to use in the bonus round.

Referring again to the example illustrated in FIG. 5, after a game initiating "first" wager is received from an originating "first" player to play the wagering game 530, a "first" outcome of the base-game portion of the wagering game 530 is randomly determined (e.g., selected via an RNG) from a plurality of possible base-game outcomes. As indicated above, the first base-game outcome can be visually represented by a plurality of symbols (15 in the illustrated example) arranged on the primary display device 514 in the array 532. The first base-game outcome may include a "start-bonus" outcome. In the illustrated embodiment, a BONUS CHALLENGE is initiated when the player collects a predetermined number of BONUS symbols 566 (e.g., five in FIG. 5). A bonus symbol bank 550 on the display 514 shows the number of BONUS symbols 566 that have already been collected by the player; in the illustrated example, the first player has already collected three BONUS symbols 566. In the most recent base-game outcome of the wagering game 530, the first and second reels 521 and 522, respectively, each includes a BONUS symbol 566 in the third column of the array 532. Thus, the first player has now collected to the requisite five BONUS symbols 566 to trigger the BONUS CHALLENGE feature.

Figure 6:
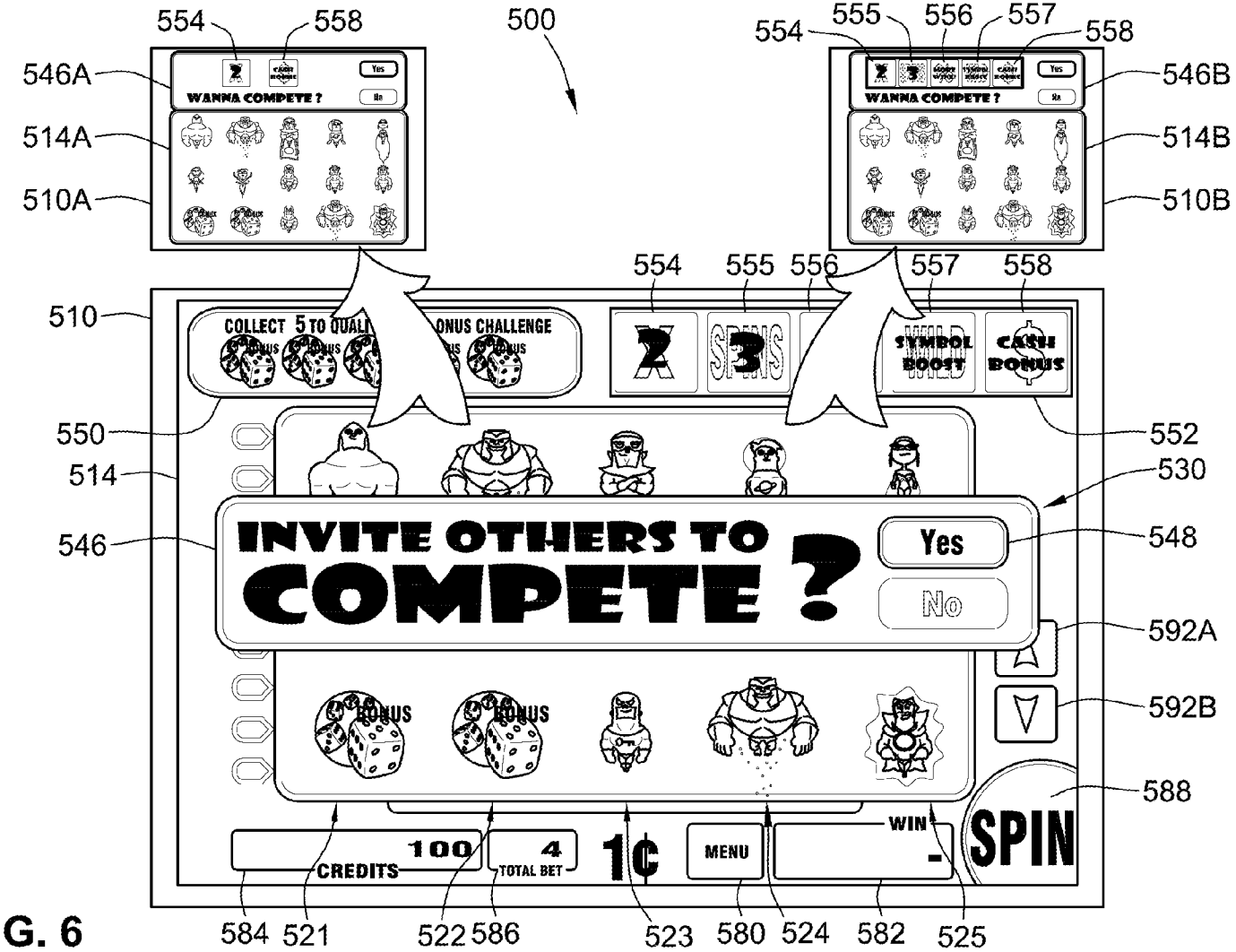
FIG. 6 is a diagrammatic illustration of the exemplary display device and wagering game of FIG. 5 showing a competition challenge of the wagering game being distributed to a plurality of secondary players with an option for those players to compete in the competition feature.

Once the BONUS CHALLENGE feature has been triggered, an offer to participate in a competitive gaming feature can be transmitted to and shared with one or more additional (or "secondary") players. FIG. 6, for example, diagrammatically illustrates an offer to participate in a competitive gaming feature being disseminated to two other players with an option for each of those players to compete in the competitive gaming feature as seen, for example, in the WANNA COMPETE? popup windows 546A and 546B. In particular, FIG. 6 shows the display screens 514A and 514B of two separate gaming devices 510A and 510B, respectively. The gaming devices 510A-B may be take on the form of any of the devices disclosed herein or otherwise known that are operatively configured for playing a wagering game. By way of non-limiting example, the first gaming device 510A of a first additional player may be a free standing, upright gaming terminal located in the same gaming establishment and on the same gaming system 500 as the gaming terminal 510. Contrastingly, the second gaming device 510B of a second additional player may be a personal computing device or mobile smartphone that is remote from any land-based gaming establishment and operatively connected to the gaming terminal 510, for example, via the internet 122 of FIG. 4.

According to the illustrated embodiment, the option to transmit the challenge is provided in response to a triggering event in the base-game outcome of the wagering game 530. The triggering event may be in the nature of a symbol-based trigger, as discussed above, or may be a time-based trigger, a wager-based trigger, a collection-based trigger, a mystery trigger, etc., in or during the basic wagering game. An alternative example of a symbol-based trigger may require a predetermined number of BONUS symbols 566 appearing on an active payline in the base-game outcome. It is within the scope and spirit of the present disclosure to employ alternative mechanisms for triggering the ability to transmit the challenge. Optionally, the ability to transmit a challenge may not require a triggering event.

In some embodiments, a player may be required to meet certain eligibility requirements to qualify for the option to transmit a challenge. The eligibility may be based on a number of factors, including acquisition of certain game assets (e.g., a key), reaching certain game milestones (e.g., completing a bonus game), exceeding a certain level of wagering activity, being a member of a certain gaming establishment group (e.g., casino player's club), and the like. Alternative arrangements can be designed to automatically transmit a challenge to other players without an input from the player. In a similar regard, the option to transmit a challenge may be presented to and selected by a player prior to initiation of play of the wagering game.

With the five BONUS symbols 566 displayed in the bonus symbol bank 550, the first player may be asked, e.g., via a popup window 546, whether to INVITE OTHERS TO COMPETE? in the competitive gaming feature. As seen in FIG. 6, the player has selected the YES button 548 (e.g., via an overlaying touch screen) to distribute the challenge. Optional variations may forego a visual or audible prompt; such configurations can allow or require the player to make a selection prior to each, every, or only selected plays of the wagering game 530. In yet another alternative variation, the determination to transmit the challenge may be automated. Transmitting the challenge may optionally include providing information regarding the potential awards associated with competing in the challenge.

Some embodiments may require the player to submit additional credits (a "side wager"), on top of the original wager received to initiate the wagering game, to transmit a challenge. The amount of additional credits may depend, for example, on the number of secondary players to whom the challenge is being sent, the potential value of winning the challenge, etc. Some configurations will allow players to use virtual currency (e.g., Facebook® credits) to pay for the transmittal. Alternatively, players can choose to purchase a SUSPEND MODE with an added upfront fee. By choosing this option before play of the wagering game 530 commences, the player can choose whether or not (and, in some embodiments, when) to suspend game play, then via community or social feed, transmit, post, sell, auction, and/or gift the option to compete in the competitive gaming feature. As opposed to submitting an additional wager to transmit and/or participate in the competitive gaming feature, characteristics of the wagering game can be modified to offset the additional winning opportunities garnered by transmitting the challenge to compete in the competitive gaming feature to additional players. This concept will be developed in further detail below.

Transmitting the challenge to one or more additional players may include posting the challenge on a social networking website, such as a Facebook® page or a Twitter® feed, that is external to the gaming system 500. For example, the player may use money (e.g., game credits) or virtual currency (e.g., Facebook® credits) to pay to suspend game play and post a challenge, e.g., on their Facebook® wall or through a centralized Twitter® account, and thereby advertise its availability. In this regard, the additional players to whom the challenge can be transmitted may be restricted to those who are members with the originating player of a designated group within a particular social networking website. For example, the player may be restricted to people with whom she/he is designated as a "friend" through Facebook® or Myspace®, part of a common "circle" on Google+®, a "follower" of or "followed" by on Twitter®, a "contact" or "group" member on Linkedin®, etc. Optionally, each additional player who wishes to be eligible to receive a challenge may be required to sign up and/or pay to be an eligible recipient, e.g., at a casino webpage. Moreover, when a player initiates play of the wagering game 530, the gaming system 500 or gaming terminal 510 could be configured to automatically access one or more of the player's social networking accounts (and optionally provide access to the account from the gaming terminal 510), and/or automatically sync future game play to those accounts (e.g., start randomly picking "friends" and/or "contacts" that are added to a distribution list). In some configurations, the player designates a distribution list, whereas other configurations employ a randomly generated distribution list.

The gaming manufacturers and proprietors may be allowed to contain or otherwise regulate how many people and which people can receive any or all challenges. Optionally, this feature can be limited by predetermined geographic restrictions. For example, distribution of the challenge may be limited to friends at the same bank of gaming terminals, friends within the same gaming establishment, friends within X-number of miles of the player, or friends within a particular city or state. Such geographic restrictions may depend, for example, on the content and potential payout of the challenge. One non-limiting example includes limiting distribution of a high-payout challenge to players within that gaming establishment, whereas a medium-payout challenge may be distributed to people anywhere in that state. In a similar regard, the distribution list may be limited to a particular environment (e.g., Facebook®) and/or a group within that environment (e.g., limited to family members and/or immediate friends on Facebook®). In this regard, a secondary player who wishes to be considered for the competitive gaming feature may use a GPS-based location detection feature or a social network feature to establish eligibility, for example, by using Foursquare® or Facebook® to "check in" to a particular casino or other specified location. When a challenge is selected for distribution, the gaming system 500 can determine which people are eligible to participate in the feature based upon recent check-in's. By way of contrast, the player could be allowed to generate a mass transmission (e.g., a "bulk email") to any number of players at any number of locations via any number of social networking accounts to maximize the virality of game feature.

There may be other criteria that determines the limitations for who and how many people are eligible to participate in a particular competitive gaming feature. The BONUS CHALLENGE feature, for example, may have time-based restrictions (e.g., each additional player must elect to participate and compete within Y-days and/or X-hours), location-based restrictions (e.g., each additional player must be within a particular gaming establishment and/or room within that establishment at the time the challenge is posted), size limitations (e.g., only the first ten people to respond can take advantage of the feature), etc. Additional eligibility constraints may require the formation of a group of players that combine to increase funds in the group's "pool" of money. For instance, each additional player may be required to be a part of a "syndicate" and pay to be a part of that syndicate. While a part of the syndicate, any player who wins a competition may be required to share the winnings with the other members in the syndicate. It is generally not necessary for the additional players (e.g., the network friends) to be playing at the same time as the originating player or each other. Optionally, whenever an additional player logs onto their social networking account or a personal email account, they will be notified that the originating player sent a challenge to compete in the competitive gaming feature.

Other options may include a dynamic system to determine how many people can be challenged, how many people can participate in the competitive gaming feature, and/or how much each additional player will be required to pay/wager to compete in the challenge based, for example, on the potential winnings from the competitive gaming feature. For instance, when the challenge is posted on the player's Facebook® page or Twitter® feed, e.g., after the player submits an additional "side" wager, the gaming system 500 may dynamically determine the number of people who can pay to take advantage of the BONUS CHALLENGE feature and/or a different amount each person has to pay to take advantage of the feature. One example may require at least five (5) additional players elect to take advantage of the BONUS CHALLENGE feature, and each person must wager at least 30 credits.

As indicated above, some configurations will allow players (both the originating player and the additional player(s)) to use virtual currency (e.g., Facebook® credits) to pay for the competitive gaming feature. In a purely social gaming environment, for example, in which players are playing solely for virtual "fun" money or other alternative currency, the underlying mathematical probabilities of the game (e.g., expected value and volatility) need not be varied to accommodate the competitive gaming feature. Likewise, there need not be the same player restrictions or wager requirements in purely social gaming environment. In essence, the wagering game 530 does not need to balance out the transmittal of a potentially high-paying challenge to a large group of secondary players (e.g., 50 friends) because the wagers and payouts are based in virtual currency.

The one or more additional players to whom the challenge is transmitted could be determined by displayed indicia in the base-game outcome of the wagering game 530. By way of example, and not limitation, the bonus-challenge-triggering BONUS symbols 566 aligned along an active payline 571 could each be modified to include indicia of the identity of a secondary player. Such indicia may include incorporating one or more bonus-triggering symbols 566 each with a Facebook® profile picture of one of the player's Facebook® friends. When the player collects the requisite number of bonus-challenge-triggering BONUS symbols 566, which are displayed in the bonus symbol bank 550, the challenge is automatically sent to the Facebook® friends depicted in the collected BONUS symbols 566. Automated variations could include the gaming system 500 pulling and randomly selecting people from a catalogue of potential players (e.g., a player's Facebook® friend list).

Other variances may require the first player to tag players for inclusion in the competitive gaming feature, or select a particular group of contacts or a photo album from which the additional players are chosen by the system 500. Alternatively, the indicia could include other player information, such as an additional player's Twitter® ID (or "handle"), or the location of a group of potential players, such as the name or emblem of particular social networking website, a specific city, or a particular gaming establishment. In addition (or as an alternative) to utilizing reel symbols with indicia of potential secondary players, indicia could be incorporated into other aspects of the wagering game, such as active paylines, the cards of a poker or blackjack hand, the spots on a betting field in roulette or craps, ball numbers in a keno or bingo game, etc. Additional aspects may include mapping the competitive gaming feature to people having similar likes as the originating player.

Figure 7:
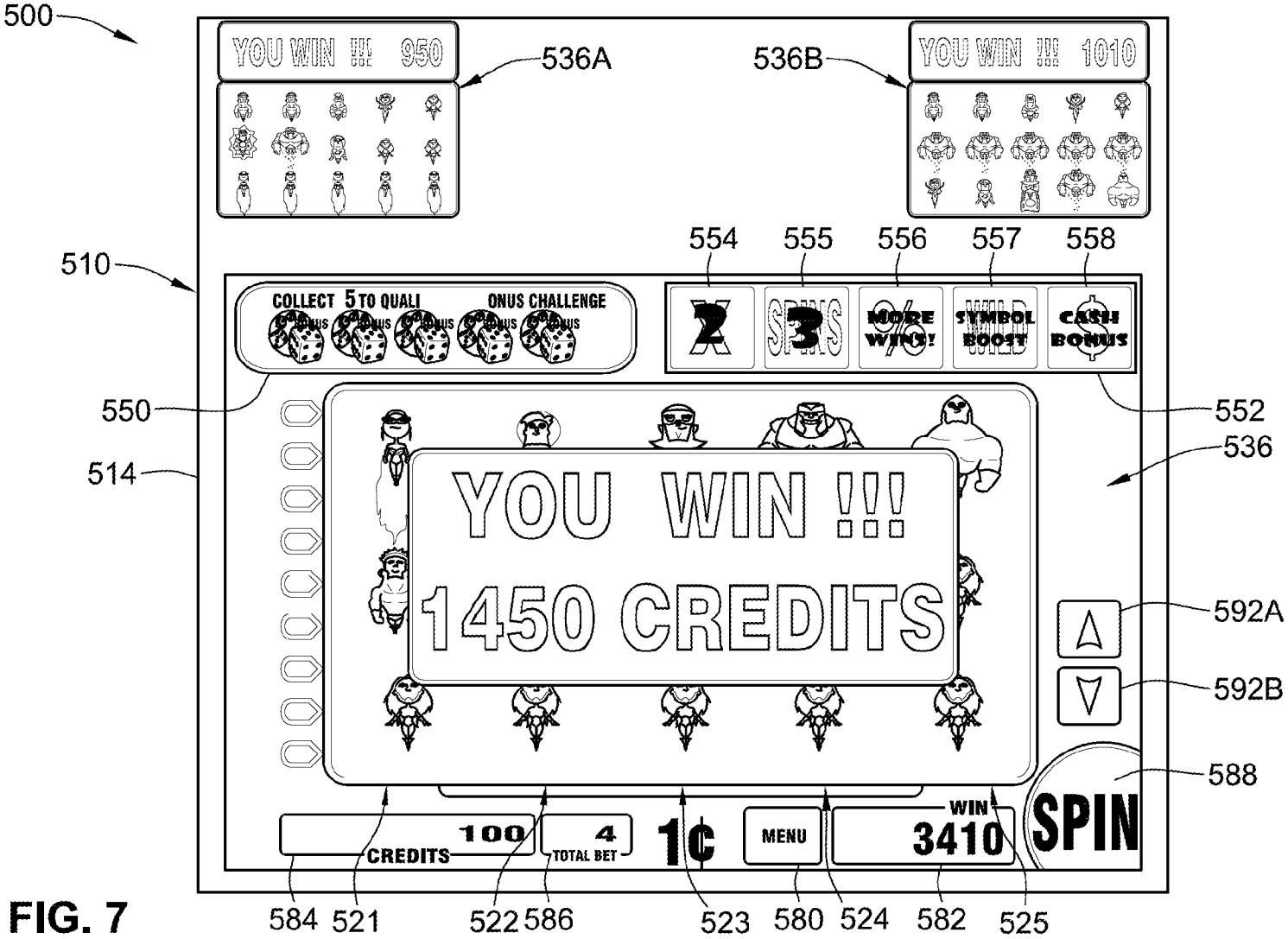
FIG. 7 is a screen shot of a display device displaying the exemplary wagering game of FIG. 5 showing a respective final outcome of the competition feature for the initial "sending" player and each of the secondary "recipient" player(s).

Once the challenge is transmitted to one or more additional players, as illustrated in FIG. 6, a "first" final outcome of the competitive gaming feature is displayed to the first player, for example, as seen in FIG. 7. The first final outcome of the competitive gaming feature may be randomly determined prior to, during, or after the transmission of the challenge. In some embodiments, after the challenge is initiated (e.g., by pressing the YES button 548 in the INVITE OTHERS TO COMPETE? popup window 546), the gaming system 500 can reevaluate and reassign the mathematical probability of achieving a winning final outcome (or achieving a high-payout winning outcome) for one or more of the competing players based, for example, on how many people to whom the challenge is transmitted, the potential payout of the challenge, the initial and/or additional wagers, etc. Two factors that may be modified to offset the number of additional players are the probability and the payout for an outcome. For instance, each new friend added by a player to the distribution list results in an incremental decrease in the probability of a payout and/or a potential payout value. In some embodiments, the probability and potential payout can be varied from player to player. In other optional configurations, the wagering game 530 could draw on coin-in (i.e., a percentage of money wagered) from a progressive jackpot to offset the number of additional players.

In any variation, the final outcomes of the competitive gaming feature for the originating and additional players are typically not displayed to the first player until after distribution of the challenge and acceptance by the additional player(s) to participate in the challenge. The primary display device 514 is shown in FIG. 7 revealing to the first player the various final outcomes of the competitive gaming feature, including the first final outcome 536 of the first player, a "second" final outcome 536A of the competitive gaming feature for a "second" player (or "first secondary player"), and a "third" final outcome 536B of the competitive gaming feature for a "third" player (or "second secondary player"). Each of the final outcomes, as shown, comprises a respective plurality of symbols of a respective plurality of symbol-bearing reels arranged in a respective array. In some embodiments, the final outcome for each competing player may consist of a single outcome associated with a single play of a base or bonus wagering game (e.g., spinning, stopping and evaluating a respective set of symbol-bearing reels once). Alternatively, the final outcome for each competing player may include an aggregation of a plurality randomly determined game outcomes associated with a plurality of plays of a wagering game (e.g., spinning, stopping and evaluating a respective set of symbol-bearing multiple times). It may be desirable, in at least some preferred embodiments, for each competing player to complete a sequence of bonus spins (e.g., ten successive bonus-reel spins), wherein the final outcome of the competitive gaming feature for that player consists of the mathematical sum of all credits awarded during the sequence of bonus spins. Some optional configurations may allow the transmitting player to define the number of plays in the sequence.

It should be readily apparent that greater or fewer than three final outcomes could be generated for the competitive gaming feature, each of which may comprise different symbols from those shown in FIG. 7. All of the final outcomes 536, 536A, 536B can be randomly determined separately from each other. Determining the additional final outcomes 536A, 536B can be at least partially in response to the additional players electing to compete in the challenge (e.g., via popup windows 546A and 546B of FIG. 6) and/or the submission of an additional wager from each of the additional players after the transmission of the challenge. Moreover, it may be desirable that the gaming system 500 and/or gaming terminal 510 conduct each/all of the random determinations for the competitive gaming feature; nevertheless, each additional player may receive, initiate, conduct and/or view the gaming feature remotely (e.g., on their own personal computing device while visiting a social networking site).

Once the final outcomes for the players of the competitive gaming feature are established, a winner of the competitive gaming feature is determined. As indicated above, the competitive gaming feature may comprise head-to-head (e.g., player vs. player (PvP)) game play where the first player competes against each of the secondary players, and the winner for each competition is selected from between the first player and each secondary player (e.g., the competitive gaming feature may have multiple winners, one for each head-to-head competition). Optionally, the competitive gaming feature may be a tournament-style competition where the first player and all of the participating secondary players compete to establish a single top winner. As with many tournament-style competitions, however, the competitive gaming feature can include multiple winners, whether it be one or more top winners who split the tournament winnings evenly, a group of top winners segregated into a finishing order—first place, second place, third place, etc.—each of whom is awarded a portion of the tournament winnings corresponding to their respective finishing position, or a hybrid thereof. It is also plausible to incorporate head-to-head game play into a tournament-style competition.

According to the illustrated example, a valuation process is conducted for the final outcomes 536, 536A, 536B to determine the winner of the competitive gaming feature. By way of non-limiting example, the gaming system 500 and/or gaming terminal 510 will determine a respective value for each of the first, second and third final outcomes 536, 536A, 536B. As indicated above, the value of each final outcome may consist of the total credits accumulated by that player in a single play of a wagering game, or the value of each final outcome may consist of the total credits accumulated by that player in a pre-defined "set" of plays of a wagering game (e.g., a pre-set number of free spins in a bonus round in slots, a pre-set number of video poker hands, a pre-set number of roulette spins, etc.). In response to the valuation of the first final outcome being better/greater than the valuation of the second final outcome, the first player is awarded an award associated with the competitive gaming feature. Likewise, if the valuation of the first final outcome is better/greater than the valuation of the third final outcome, the first player can be awarded another award associated with the competitive gaming feature. Conversely, if the valuation of the second final outcome (or third final outcome) is better/greater than the valuation of the first final outcome, the award associated with the competitive gaming feature is awarded to the second player (or the third player). Optionally, if the valuation of the second final outcome is better/greater than the valuation of the first final outcome, but worse/less than the valuation of the third final outcome, the award associated with the competitive gaming feature is awarded to the third player.

In the example illustrated in FIG. 7, the first final outcome 536 has an award value of 1450 credits, which were accumulated by the first player during the competitive gaming feature. Moreover, the second final outcome 536A has an award value of 950 credits accumulated by the second player during the competitive gaming feature, and the third final outcome 536B has an award value of 1010 credits accumulated by the third player during the competitive gaming feature. Since the valuation of the first final outcome is better/greater than the valuations of the second and third final outcomes, the first player has won the competitive feature and is, thus, awarded the award associated with the competitive gaming feature. In some embodiments, the award associated with the competitive gaming feature is at least the sum of the award values associated with the all of the final outcomes. According to the WIN meter 582 of FIG. 7, for example, the first player is awarded 3410 credits—the mathematical sum of the 1450-credit award value of the first final outcome 536, the 950-credit award value of the second final outcome 536A, and the 1010-credit award value of the third final outcome 536B.

Although not portrayed in the drawings, it is also possible for one or more of the secondary players to win all or a portion of the competitive gaming feature. For instance, if the first final outcome 536 had an award value of 975 credits instead of 1450 credits, the first player would be awarded 1925 credits—the mathematical sum of the new 975-credit award value of the first final outcome 536 and the 950-credit award value of the second final outcome 536A. However, in this example, the second player would be awarded 1985 credits—the mathematical sum of the new 975-credit award value of the first final outcome 536 and the 1010-credit award value of the third final outcome 536B. Some aspects of the disclosed concepts can include awarding an award to all of the players who elect to participate in the competitive gaming feature.

The above game configuration incentivizes the first player to distribute the challenge to as many people as possible in order to increase the first player's chances of winning the competitive gaming feature. In so doing, the virality of the game is increased. Some variances can include methods of gifting a challenge, which are readily amendable to social gaming applications. Optionally, the first player, alone or with one or more of the additional players, can receive a non-monetary benefit as part of the competitive gaming feature. Such benefits may include free concert tickets, free meals, a free room at the casino/hotel, or any number of prizes that that particular establishment wishes to offer.

The competitive gaming feature may be completely skill-based (e.g., a chess tournament), completely chance-based (e.g., a slots tournament), or a hybrid thereof (e.g., a blackjack tournament). In the embodiment illustrated in FIGS. 5-7, for example, the competitive gaming feature is a slot-style competition, which is typically designed to be purely a game of chance. However, aspects of the slot based competition can be varied to introduce skill and strategy into the competition. For instance, the competitive gaming feature can include one or more competition-game enhancements that are collected during play of a base game of the wagering game 530, and strategically applied by a player during execution of the competitive gaming feature. Each competition-game enhancement is designed to increase the valuation of a final outcome of the competitive gaming feature. A spin-enhancement queue 552 on the display 514 shows a number of spin enhancements 554-558 that have already been collected by the first player: a 2× multiplier enhancement 554, a 3 SPINS enhancement 555, a MORE WINS enhancement 556, a WILD SYMBOL BOOST enhancement 557, and a CASH BONUS enhancement 558. The 2× multiplier enhancement 554 can be selectively applied to a game outcome, before, during or after that spin is initiated, to double the value of any award associated with that outcome. The 3 SPINS enhancement 555, on the other hand, provides a player with three additional spins, e.g., on top of the ten successive bonus-reel spins that are automatically played, during completion of the competitive gaming feature. The MORE WINS enhancement 556 can be selectively applied to a game outcome, before, during or after that spin is initiated, to increase the probability that the outcome will include a winning symbol combination.

The WILD SYMBOL BOOST enhancement 557 can be selectively applied to include one or more WILD symbols in the next outcome and, thus, increase the probability that the outcome will include a winning symbol combination. Lastly, the CASH BONUS enhancement 558 increases the award value of a final outcome by a predetermined or random number of additional credits.

The competitive gaming feature can include greater or fewer competition-game enhancements than the five shown in FIG. 5. Moreover, the competition-game enhancements may take on alternative forms than those shown in the drawings and described above. For example, the competition-game enhancements can include multipliers of different magnitudes (e.g., a 5× multiplier), WILD REEL boosts that replace an entire reel with WILD symbols for an outcome, a REEL LOCK enhancement which allows the player to select and lock one or more reels, which they perceive to have a higher likelihood of winning, for one or more subsequent outcomes, etc. Another type of competition-game enhancement may include a BLOCK, which can be strategically employed to prevent another player from using an enhancement during a particular outcome or outcomes.

As part of the challenge, the secondary players can be provided with one or more of the competition-game enhancements, which they can then strategically apply during play of the competitive gaming feature. The competition-game enhancements may be provided for free to the secondary players. Optionally, the secondary players may be given the option (or may be required) to purchase the competition-game enhancements before participating in the competitive gaming feature. Aspects of the present disclosure may even allow the first player to sell competition-game enhancements to the secondary players. In some embodiments, the secondary players are provided with one or more of the competition-game enhancements collected by the first player during play of the base game of the wagering game. FIG. 6, for example, shows that the second player is provided with the 2× multiplier enhancement 554 and the CASH BONUS enhancement 558, both of which are displayed on the display screen 514A of the gaming device 510A in the challenge popup window 546A. In some embodiments, one or more of the additional players, during play of the competitive gaming feature, are provided with the same competition-game enhancements collected by the first player during play of the base game of the wagering game 530. The display screen 514B of the gaming device 510B in FIG. 6, for example, shows that the third player is provided with all five of the spin enhancements 554-558 that were collected by the first player.

It is desirable, in at least some embodiments, that the odds of winning the gaming feature are the same for all of the participating players. Antithetically, the odds of winning the gaming feature may be different from participating player to player. As indicated above, the odds may be varied, for example, by controlling the number and type of competition-game enhancements provided to each of the competing players. To further incentivize the transmittal of the challenge to as many secondary players as possible, the first player may be provided with better odds of winning the competitive gaming feature. Optionally, the competitive gaming feature may incorporate a "handicap" to balance any difference in odds during the challenge.

It may also be desirable to provide the secondary players with incentives to accept a challenge and participate in the competitive gaming feature. For instance, the competitive gaming feature can include at least some gaming content (e.g., symbols, levels, bonus segments, etc.) that the second player is not otherwise eligible to play but for accepting the offer to participate in the competitive gaming feature. A challenge can be specific to a particular game such that the challenge can be sent to a secondary player to play a high-level game even if that secondary player would not otherwise be eligible to play that high-level game (e.g., they haven't "unlocked" that game or corresponding game content during their own game play). Moreover, the secondary players can become eligible, even if only temporarily, for enhancements that they would otherwise not be eligible for. This allows players to have a chance to play games or play game content for which they aren't otherwise eligible, even if only for a brief time, when accepting and competing in the feature challenge. Another incentive, which is more commonplace, is providing the secondary players with the ability to win awards (monetary and/or non-monetary) for winning the competitive gaming feature.

When sending challenges, the competitive gaming feature may also qualify players for overall tournaments that are general leaderboards. This concept of "tournament" play opens up the competitive gaming feature to including a larger multi-player, network-wide leaderboard. Players may be required to opt in to play for the tournament prior to their bonus starting. For example, the tournament may have an "entry fee" that must be paid by each player prior to the competitive gaming feature being played. In some configurations, if the bonus game doesn't pay above a certain threshold, the entry fee may be returned to the player. For example, when a secondary player receives a challenge, they also have the option to pay a certain number of credits to have their final outcome value (or "score") entered into a larger tournament of players who have taken the same challenge. In this instance, the primary and secondary player still have a head-to-head competition; however, some players may elect to enter into a larger tournament in hopes that their score is one of the top scores during the tournament time period.

In some embodiments, players can also form teams to enter into tournaments. Team tournaments can depend on entries from each player on the team during a set window of time. By way of example, there may be a weekly tournament for a player's team, and they need to play a specific game, and accomplish a predetermined triggering event in that game, to qualify for the tournament. When players have teammates counting on them for a tournament, they may be more willing to pay and play in order to meet the tournament requirements. Tournaments can be held on a daily, weekly, and/or monthly basis. Tournaments can also offer several touch points for the players. For instance, they can be contacted when their position on the leaderboard has dropped (and offer them the ability to buy back in), to provide them with the results from the tournament, and when their teammates have posted scores, etc.

The various features and aspects of the present disclosure are not per se limited to slot games; these features and aspects can be applied to many different types of wagering games that can be formatted as a multi-player competition. Some non-limiting examples include applying the competitive gaming feature to bonus games, progressive games, well-known communal games, such as Bingo, skill based games, such as electronic bowling, and sports games, such as fantasy sports, sports wagering, etc.

Figure 8:
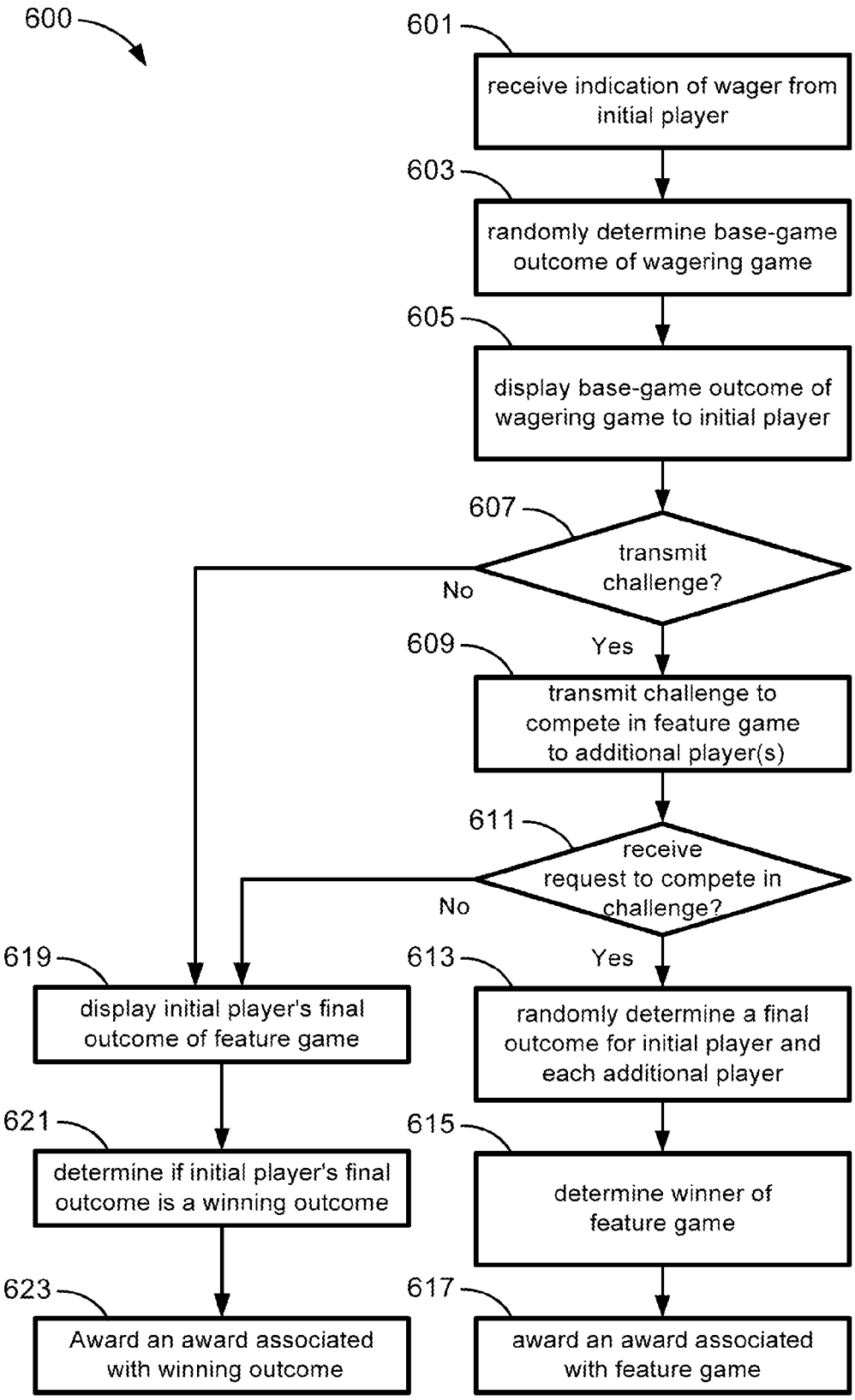
FIG. 8 is a flowchart for an exemplary method or algorithm that can correspond to instructions that can be stored on one or more non-transitory computer-readable media and can be executed by one or more controllers in accord with aspects of the disclosed concepts.

With reference now to the flow chart of FIG. 8, an improved method for conducting a wagering game on a gaming terminal and/or a gaming system, such as those shown in FIGS. 1-5, for example, is generally described at 600 in accordance with aspects of the present disclosure. FIG. 8 can be representative of an algorithm that corresponds to at least some instructions that can be stored, for example, in main memory 32 of FIG. 2, and executed, for example, by the CPU 30 and/or external system(s) 48 of FIG. 2 to perform any or all of the above or below described functions associated with the disclosed concepts. The method 600 will be described with reference to the various aspects and features shown in FIGS. 4-7 of the drawings; such reference is being provided purely by way of explanation and clarification.

The method 600 begins at block 601 by receiving (e.g., via an input device such as touch screen 18, bill validator 22, information reader/writer 24, etc.) an indication of a wager to play a wagering game. At block 603, an outcome of a base-game portion of the wagering game is randomly determined. This may include, as indicated above, an RNG generating a random number, game logic for determining the outcome based on the randomly generated number, and the CPU 30, the external system 48, or both, in alternative embodiments, operating to execute a wagering game program, and game assets (e.g., art, sound, etc.) for presenting the determined outcome to a player in a visual manner. The base-game outcome of the wagering game is visually represented by a plurality of symbols arranged on a display device, such as the symbol array 532 of FIG. 5.

At block 605, the method 600 displays the base-game outcome to the first player and, in some embodiments, temporarily suspends regular play of the wagering game. Block 607 includes a determination of whether to transmit a challenge to one or more additional players. As indicated above, this determination can be responsive to a triggering event during play of the wagering game, can require meeting certain eligibility requirements, could be completely random, could be transmitted automatically by the gaming terminal/system, may require an input from the first player, may require an input from each of the additional players, may be responsive to the base-game outcome including certain symbols or features, etc. If it is determined that the challenge should be transmitted (block 607=Yes), the challenge is distributed to one or more additional players at block 609. If not (block 607=No), the method proceeds to block 619 and the initial player's final outcome of a (bonus) gaming feature is displayed.

With continuing reference to FIG. 8, the method 600 includes, at block 611, determining whether any requests and/or confirmations to participate in the wagering game challenge have been received. Each request may require the additional player meet certain eligibility requirements, may require an active election to participate, and/or may require the submission of a wager from each of the additional players. If no requests and/or confirmations are received (block 611=No), the method proceeds to block 619 and the initial player's final outcome of a (bonus) gaming feature is displayed. Prior to, during or after displaying the initial player's final outcome, the method 600 determines at block 621 if the initial player's final outcome is a winning outcome (e.g., includes one or more winning symbol combinations). If so, block 623 will award an award associated with the winning outcome(s).

Upon receipt of such requests (block 611=Yes), a final outcome of the competitive gaming feature is randomly determined for each of the players at block 613. The final outcome for each additional player is randomly determined separately from the final outcome of the initiating player. Moreover, the final outcomes may take on any of the forms described above with respect to FIG. 7. In this regard, the initial player's final outcome may be displayed prior to receiving any requests from secondary players to participate in the competitive gaming feature at block 611, e.g., immediately after transmitting the challenge at block 607. Block 615 will determine a winner of the competitive gaming feature, and block 617 will award an award associated with the competitive gaming feature to the winner. Any of the alternative payout options discussed hereinabove with respect to FIG. 7 can be similarly applied in the algorithm presented in FIG. 8.

In some embodiments, the method 600 includes at least those steps enumerated above. It is also within the scope and spirit of the present disclosure to omit steps, include additional steps, and/or modify the order presented above. It should be further noted that the method 600 represents a single play of a wagering game. However, it is expected that the method 600 be applied in a systematic and repetitive manner.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well-known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

While many representative embodiments and exemplary modes for carrying out the present invention have been described in detail above, those familiar with the art to which this invention relates will recognize various alternative designs and embodiments for practicing the invention within the scope of the appended claims.

What is claimed is:

1. A gaming system primarily dedicated to conducting a casino wagering game, the gaming system comprising:

an electronic gaming machine with a cabinet, one or more external system communication interfaces coupled to the cabinet and configured to communicatively connect with an external system over a network, one or more electronic input devices coupled to the cabinet and configured to receive a physical input from a first player and transform the physical input into an electronic data signal, and one or more electronic display devices coupled to the cabinet and operable to display aspects of the casino wagering game;

game-logic circuitry comprising one or more processors; and one or more memory devices storing processor-executable instructions that, when executed by at least one of the one or more processors, cause the gaming system to:

detect, via at least one of the one or more electronic input devices, a physical item associated with a monetary value that establishes a credit balance;

initiate the casino wagering game in response to the electronic data signal generated by the one or more electronic input devices in response to the physical input from the first player, the physical input being indicative of a first wager covered by the credit balance;

determine an outcome of the casino wagering game based, at least in part, on one or more random elements generated by at least one of one or more electronic random element generators;

display, via at least one of the one or more electronic display devices, the randomly determined outcome of the casino wagering game to the first player;

in response to a triggering event in the outcome of the casino wagering game, transmit, via at least one of the one or more external system communication interfaces to the external system over the network, an electronic offer to participate in a competitive gaming feature to at least a second player, the competitive gaming feature including unlockable gaming content that the second player has not yet unlocked and currently is not eligible to play but for accepting the offer to participate in the competitive gaming feature;

randomly determine a first final outcome of the competitive gaming feature for the first player;

randomly determine a second final outcome of the competitive gaming feature for the second player;

in response to a valuation of the first final outcome being better than a valuation of the second final outcome, award an award associated with the competitive gaming feature to the first player; and receive, via at least one of the one or more electronic input devices, a cashout input that initiates a payout from the credit balance.

2. The gaming system of claim 1, wherein the stored instructions further cause the gaming system to determine a first award value associated with the first final outcome and a second award value associated with the second final outcome, wherein the award associated with the competitive gaming feature is at least the sum of the first and second award values.

3. The gaming system of claim 1, wherein the stored instructions further cause the gaming system to, in response to the valuation of the second final outcome being better than the valuation of the first final outcome, award the award associated with the competitive gaming feature to the second player.

4. The gaming system of claim 1, wherein the stored instructions further cause the gaming system to:

in response to the triggering event in the wagering game, transmit the electronic offer to participate in the competitive gaming feature to at least a third player;

randomly determine a third final outcome of the competitive gaming feature for the third player; and in response to the valuation of the first final outcome being better than a valuation of the third final outcome, award another award associated with the competitive gaming feature to the first player.

5. The gaming system of claim 1, wherein the competitive gaming feature includes one or more competition-game enhancements collected during play of a base game of the wagering game, each of the competition-game enhancements being respectively operable to increase a valuation of a final outcome of the competitive gaming feature.

6. The gaming system of claim 5, wherein the second player, during play of the competitive gaming feature, is provided with one or more of the competition-game enhancements collected by the first player during play of the base game of the wagering game.

7. The gaming system of claim 6, wherein the second player, during play of the competitive gaming feature, is provided with the same competition-game enhancements collected by the first player during play of the base game of the wagering game.

8. The gaming system of claim 1, wherein the unlockable gaming content includes a bonus game segment or a high-level game that the second player has not yet unlocked.

9. The gaming system of claim 1, wherein the transmitting the offer to participate in the competitive gaming feature to at least the second player is responsive to a command received from the first player.

10. The gaming system of claim 1, wherein the instructions also cause the gaming system to display the randomly determined outcome, but not the first and second final outcomes of the competitive gaming feature, prior to transmitting the offer to participate in the competitive gaming feature to at least the second player, and to display the first and second final outcomes after transmitting the offer to participate in the competitive gaming feature.

11. The gaming system of claim 1, wherein the displaying the randomly determined outcome is responsive to the first wager received from the first player, and the transmitting the offer to participate in the competitive gaming feature to at least the second player is responsive to a second wager further to the first wager received from the first player.

12. The gaming system of claim 1, wherein the displaying the randomly determined outcome is responsive to the first wager received from the first player, and the randomly determining the second final outcome is at least partially in response to an additional wager received from the second player.

13. The gaming system of claim 1, wherein the transmitting the offer to participate in the competitive gaming feature includes posting the offer to participate on a social networking website, the second player being within a social network of the first player as defined by the social networking website.

14. The gaming system of claim 1, wherein the transmitting the offer to participate in the competitive gaming feature is to a plurality of additional players, the first player and the plurality of additional players all being members of a designated group of a social networking website.

15. The gaming system of claim 1, wherein the triggering event is a start-bonus outcome in a base game of the wagering game.

16. The gaming system of claim 1, wherein the first final outcome includes a first plurality of symbol-bearing reels spinning and stopping to reveal a first plurality of randomly determined game outcomes, and the second final outcome includes a second plurality of symbol-bearing reels spinning and stopping to reveal a second plurality of randomly determined game outcomes.

17. A method of conducting a casino wagering game on a gaming system primarily dedicated to conducting the casino wagering game, the gaming system including game-logic circuitry and an electronic gaming machine with at least one electronic input device configured to receive physical inputs from players and transform the physical inputs into electronic data signals, at least one electronic display device configured to display outcomes of the wagering game, and at least one external system communication interface connected with an external system, distinct from the gaming system, over a network, the game-logic circuitry including at least one processor, the method comprising:

detecting, via the at least one electronic input device, a physical item associated with a monetary value that establishes a credit balance;

receiving, via the at least one electronic input device, a physical input from a first player as an indication of a wager to play the casino wagering game;

initiating, via the at least one processor, the casino wagering game in response to an electronic data signal generated by the at least one electronic input device responsive to the physical input of the wager from the first player, the wager being covered by the credit balance;

randomly determining, via the at least one processor, an outcome of the casino wagering game for the first player based, at least in part, on one or more random elements generated by at least one electronic random element generator;

displaying, via the at least one electronic display device, the randomly determined outcome of the casino wagering game to the first player;

in response to a triggering event in the casino wagering game, transmitting, via the at least one external system communication interface to the external system over the network, an electronic offer to participate in a competitive gaming feature to at least a second player, the competitive gaming feature including unlockable gaming content that the second player has not yet unlocked and currently is not eligible to play but for accepting the offer to participate in the competitive gaming feature;

randomly determining, via the at least one processor, a first final outcome of the competitive gaming feature for the first player;

randomly determining, via the at least one processor, a second final outcome of the competitive gaming feature for the second player;

in response to a valuation of the first final outcome being better than a valuation of the second final outcome, awarding an award associated with the competitive gaming feature to the first player; and receiving, via the at least one electronic input device, a cashout input that initiates a payout from the credit balance.

18. A gaming system primarily dedicated to conducting a wagering game on a regulated gaming device with a cabinet, one or more electronic input devices coupled to the cabinet and configured for receiving physical inputs and transform the physical inputs into electronic data signals, at least one external system communication interfaces operable to connect with an external system over a network, and one or more electronic display devices coupled to the cabinet and configured for displaying aspects of the wagering game, the gaming system comprising:

one or more electronic random element generators configured to generate one or more random elements associated with play of the wagering game;

game-logic circuitry comprising one or more processors; and one or more memory devices storing processor-executable instructions that, when executed by at least one of the one or more processors, cause the gaming system to:

detect, via at least one of the one or more electronic input devices, a physical item associated with a monetary value that establishes a credit balance;

receive a physical input as an indication of a first wager from a first player via at least one of the one or more electronic input devices of the regulated gaming device to play a base game of the wagering game, the first wager being covered by the credit balance;

initiate the base game of the wagering game in response to an electronic data signal generated by the at least one electronic input device in response to the physical input from the first player;

determine an outcome for the base game of the wagering game based, at least in part, on one or more random elements generated by the one or more electronic random element generators;

display the randomly determined outcome of the base game of the wagering game to the first player via the at least one electronic display device of the gaming device;

in response to a triggering event in the outcome of the base game of the wagering game and a command received from the first player via at least one of the one or more electronic input devices, transmit an offer to compete in a competitive gaming feature to a plurality of secondary players on the external system via the at least one external system communication interface, the competitive gaming feature including unlockable gaming content that one or more of the secondary players have not yet unlocked and currently are not eligible to play but for accepting the offer to participate in the competitive gaming feature;

randomly determine a first final outcome of the competitive gaming feature for the first player;

in response to one or more of the secondary players electing to compete in the competitive gaming feature, randomly determine, separate from one another and from the random determination of the first final outcome, a respective second final outcome of the competitive gaming feature for each of the secondary players who elected to compete in the competitive gaming feature;

determine a valuation of the first final outcome and a valuation of each of the respective second final outcomes;

in response to each instance where the valuation of the first final outcome is better than the valuation of one of the respective second final outcomes, award an award associated with the competitive gaming feature to the first player; and receive, via at least one of the one or more electronic input devices, a cashout input that initiates a payout from the credit balance.

19. The gaming system of claim 18, wherein the stored instructions further cause the gaming system to determine a first award value associated with the first final outcome and a respective second award value associated with each of the respective second final outcomes, wherein the competitive-gaming-feature award in each instance is at least the sum of the first award value and the respective second award value.

20. The gaming system of claim 18, wherein the competitive gaming feature includes a plurality of competition-game enhancements collected during play of the base game of the wagering game, each of the competition-game enhancements being respectively operable to increase a valuation of a final outcome of the competitive gaming feature.

21. The gaming system of claim 20, wherein each of the secondary players who elected to compete in the competitive gaming feature, during play of the competitive gaming feature, is provided with one or more of the competition-game enhancements.

22. The gaming system of claim 20, wherein each of the secondary players, during play of the competitive gaming feature, is provided with the same competition-game enhancements collected by the first player during play of the base game of the wagering game.

23. The gaming system of claim 18, wherein the unlockable gaming content includes a bonus game segment or a high-level game that the plurality of secondary players are not otherwise eligible to play but for accepting the offer to compete in the competitive gaming feature.

24. A method of operating a gaming system, the gaming system including game-logic circuitry and a regulated gaming machine, the regulated gaming machine being primarily dedicated to conducting a casino wagering game, the regulated gaming machine including a gaming cabinet with one or more electronic display devices and one or more electronic input devices coupled to the gaming cabinet, the method comprising:

detecting, via at least one of the one or more electronic input devices, a physical item associated with a monetary value that establishes a credit balance;

initiating, via the game-logic circuitry, the casino wagering game in response to a wager input from a first player indicative of a wager covered by the credit balance;

displaying, via at least one of the one or more electronic display devices, an outcome of the casino wagering game;

transmitting, over a communication network to a second player on an external computing system in response to a triggering event in the outcome of the casino wagering game, an offer to compete in a competitive gaming feature, the competitive gaming feature including unlockable gaming content the second player is not currently eligible to play but for accepting the offer to participate in the competitive gaming feature;

determining a first final outcome of the competitive gaming feature for the first player and a second final outcome of the competitive gaming feature for the second player;

in response to a first valuation of the first final outcome being better than a second valuation of the second final outcome, award an award associated with the competitive gaming feature to the first player; and receiving, via at least one of the one or more electronic input devices, a cashout input that initiates a payout from the credit balance.

25. A regulated gaming machine primarily dedicated to conducting a casino wagering game, the regulated gaming machine comprising:

a gaming cabinet;

one or more electronic input devices mounted to the gaming cabinet;

one or more electronic display devices mounted to the gaming cabinet; and game-logic circuitry configured to:

detect, via at least one of the one or more electronic input devices, a physical item associated with a monetary value, the monetary value establishing a credit balance that changes based on play of the casino wagering game;

initiate the casino wagering game in response to a wager input indicative of a first wager from a first player, the wager being covered by the credit balance;

display, via at least one of the one or more electronic display devices, an outcome of the casino wagering game;

transmit, over a communication network to a second player on an external computing system in response to a triggering event in the outcome of the casino wagering game, an offer to participate in a competitive gaming feature, the competitive gaming feature including unlockable gaming content the second player is not currently eligible to play but for accepting the offer to participate in the competitive gaming feature;

determine a first final outcome of the competitive gaming feature for the first player and a second final outcome of the competitive gaming feature for the second player; and in response to a first value of the first final outcome being larger than a second value of the second final outcome, transmit to the first player an award comprising at least the first and second values; and receive, via at least one of the one or more electronic input devices, a cashout input that initiates a payout from the credit balance.

* * * * *